US008172608B2

(12) United States Patent
Lazenby

(10) Patent No.: US 8,172,608 B2
(45) Date of Patent: May 8, 2012

(54) REUSEABLE COAXIAL CONNECTORS AND RELATED EXTRACTION TOOLS AND METHODS

(75) Inventor: Michael Edward Lazenby, Connelly Springs, NC (US)

(73) Assignee: CommScope Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/769,823

(22) Filed: Apr. 29, 2010

(65) Prior Publication Data

US 2011/0269340 A1 Nov. 3, 2011

(51) Int. Cl.
*H01R 9/05* (2006.01)

(52) U.S. Cl. ..... 439/578

(58) Field of Classification Search ..... 439/578, 439/583, 584, 271, 548, 389
See application file for complete search history.

(56) References Cited

U.S. PATENT DOCUMENTS

| | | | |
|---|---|---|---|
| 3,373,243 | A | 3/1968 | Janowiak et al. |
| 4,408,822 | A | 10/1983 | Nikitas |
| 4,834,675 | A | 5/1989 | Samchisen |
| 4,902,246 | A | 2/1990 | Samchisen |
| 5,024,606 | A | 6/1991 | Ming-Hwa |
| 5,207,602 | A | 5/1993 | McMills et al. |
| 5,342,218 | A | 8/1994 | McMills et al. |
| 5,470,257 | A | 11/1995 | Szegda |
| 5,632,651 | A | 5/1997 | Szegda |
| 5,651,698 | A | 7/1997 | Locati et al. |
| 5,690,510 | A | 11/1997 | Chishima |
| 5,863,220 | A | 1/1999 | Holliday |
| 5,879,191 | A | 3/1999 | Burris |
| 6,089,912 | A | 7/2000 | Tallis et al. |
| 6,089,913 | A | 7/2000 | Holliday |
| 6,159,046 | A | 12/2000 | Wong |
| 6,179,656 | B1 | 1/2001 | Wong |
| 6,241,553 | B1 | 6/2001 | Hsia |
| 6,352,448 | B1 | 3/2002 | Holliday et al. |
| 6,383,019 | B1 | 5/2002 | Wild |
| 6,530,807 | B2 | 3/2003 | Rodrigues et al. |
| 6,558,194 | B2 | 5/2003 | Montena |
| 6,648,683 | B2 | 11/2003 | Youtsey |
| 6,767,247 | B2 | 7/2004 | Rodrigues et al. |

(Continued)

FOREIGN PATENT DOCUMENTS

| | | | |
|---|---|---|---|
| EP | 1 777 783 | A1 | 4/1997 |

(Continued)

OTHER PUBLICATIONS

Pending U.S. Appl. No. 12/327,355, filed Dec. 3, 2008, entitled: Reuseable Coaxial Connectors and Related Methods.

(Continued)

*Primary Examiner* — Alexander Gilman
(74) *Attorney, Agent, or Firm* — Myers Bigel Sibley & Sajovec

(57) ABSTRACT

Reusable coaxial connectors include a connector body, a contact post that is at least partly within the connector body, a compression sleeve that is configured to impart a compressive force to secure one or more elements of a coaxial cable between the connector body and the contact post when the compression sleeve is in a seated position, and an internally threaded rotatable nut that is attached to the connector body. The compression sleeve includes a first recess on an external surface thereof that is configured to receive a first member of an extraction tool that is used to move the compression sleeve from its seated position to an unseated position.

18 Claims, 15 Drawing Sheets

U.S. PATENT DOCUMENTS

| | | | | |
|---|---|---|---|---|
| 6,790,083 | B1 | 9/2004 | Chen | |
| 6,817,896 | B2 | 11/2004 | Derenthal | |
| D505,391 | S | 5/2005 | Rodrigues et al. | |
| 7,074,081 | B2 | 7/2006 | Hsia | |
| 7,153,161 | B2 | 12/2006 | Huang | |
| 7,192,308 | B2 | 3/2007 | Rodrigues et al. | |
| 7,329,149 | B2 | 2/2008 | Montena | |
| 7,794,275 | B2 * | 9/2010 | Rodrigues | 439/584 |
| 2002/0013088 | A1 | 1/2002 | Rodrigues et al. | |
| 2003/0162439 | A1 | 8/2003 | Rodrigues et al. | |
| 2005/0003705 | A1 | 1/2005 | Rodrigues et al. | |
| 2005/0136735 | A1 | 6/2005 | Rodrigues et al. | |
| 2007/0049113 | A1 | 3/2007 | Rodrigues et al. | |
| 2007/0123100 | A1 | 5/2007 | Rodrigues et al. | |
| 2008/0261445 | A1 | 10/2008 | Malloy et al. | |
| 2008/0274644 | A1 | 11/2008 | Ridrigues | |
| 2008/0311790 | A1 | 12/2008 | Malloy et al. | |
| 2009/0186505 | A1 * | 7/2009 | Mathews | 439/271 |
| 2009/0233482 | A1 * | 9/2009 | Chawgo et al. | 439/578 |

FOREIGN PATENT DOCUMENTS

| | | |
|---|---|---|
| WO | WO98/18179 | 4/1998 |
| WO | WO 99/65118 | 12/1999 |

OTHER PUBLICATIONS

Pending U.S. Appl. No. 12/731,207, filed Mar. 25, 2010, entitled: Reuseable Coaxial Connectors and Related Methods.

* cited by examiner

REUSEABLE COAXIAL CONNECTORS AND RELATED EXTRACTION TOOLS AND METHODS

FIELD OF THE INVENTION

The present invention relates generally to communications connectors and, more particularly, to connectors for coaxial cables.

BACKGROUND

Coaxial cables are a specific type of communications cable that may be used to carry information signals such as television or data signals. Coaxial cables are widely used in cable television networks and/or to provide broadband Internet connectivity. FIGS. 1A and 1B are, respectively, a schematic transverse cross-sectional view and a schematic longitudinal cross-sectional view of a conventional coaxial cable 10 (FIG. 1B is taken along the cross section B-B shown in FIG. 1A). As shown in FIGS. 1A and 1B, the coaxial cable 10 has a central conductor 12 that is surrounded by a dielectric 14. A tape 16 is preferentially bonded to the dielectric 14. The central conductor 12, dielectric 14 and tape 16 comprise the core 18 of the cable. Electrical shielding wires 20 and, optionally, electrical shielding tape(s) 22 surround the cable core 18. Finally, a cable jacket 24 surrounds the electrical shielding wires 20 and electrical shielding tape(s) 22. As shown in FIG. 1B, the dielectric 14, tape 16, electrical shielding wires 20, electrical shielding tape 22 and cable jacket 24 may be cut, and the electrical shielding wires 20 may be folded back, in order to prepare the coaxial cable 10 for attachment to certain types of coaxial connectors.

Coaxial connectors are a known type of connector that may be used to connect two coaxial cables 10 or to connect a coaxial cable 10 to a device (e.g., a television, a cable modem, etc.) having a coaxial cable interface. Coaxial "F" connectors are one specific type of coaxial connector that is used to terminate a coaxial cable with a male coaxial connector.

Standards promulgated by the Society of Cable Telecommunications Engineers ("SCTE") and, more specifically, ANSI/SCTE 99 2004, specify an axial tension pull-off or retention force that a coaxial "F" connector must impart on the coaxial cable onto which it is installed. Specification of this minimum retention force ensures that the connector will resist pulling forces that may be applied to the cable during normal use such that the cable will not readily separate from the coaxial "F" connector. Other ANSI/SCTE standards specify moisture migration parameters, electrical parameters, other mechanical parameters and environmental requirements. Relevant standards documents include the ANSI/SCTE 123 2006, 99 2004, 60, 2004 and 98 2004 standards.

A number of different types of coaxial "F" connector designs are known in the art, including, but not limited to, crimped on connectors, swaged on connectors and connectors which secure the cable into the connector with compression style cable retention elements. With the crimped connector designs, typically a hexagonal-shaped tool is used to crimp a sleeve of the connector onto the coaxial cable that is to be terminated into the connector. With the swaged connector designs, the sleeve of the connector is swaged circumferentially inward so as to reduce its inside diameter in order to exert the required retention force on the coaxial cable.

Several different coaxial "F" connector designs are currently known in the art that have compression style cable retention elements. FIGS. 2-4 depict a connector 100 according to a first of these designs. As shown in FIGS. 2-4, the connector 100 includes a tubular connector body 110, a compression sleeve 130, a contact post 150 and an internally threaded nut 170. A coaxial cable 10 (not shown in FIGS. 2-4) is inserted axially into the inside diameter of the tubular connector body 110 and the compression sleeve 130 (when the connector is oriented as shown in FIGS. 2-4, the coaxial cable 10 is inserted into the right side of the connector 130). The core 18 of the coaxial cable 10 inserts axially into an inside diameter of the contact post 150, while the electrical shielding wires/tape 20/22 and the cable jacket 24 circumferentially surround the outer surface of contact post 150. The outside surface of the contact post 150 may include one or more serrations, teeth, lips or other structures 152. Once the cable 10 is inserted into the connector 100 as described above, a compression tool (not shown in FIGS. 2-4) is used to axially insert the compression sleeve 130 further into the tubular connector body 110 into its seated position in which the compression sleeve 130 locks the cable 10 in place within the connector 100. The compression sleeve 130 directly decreases the radial gap spacing between the connector body 110 and the contact post 150 so as to radially impart a 360-degree circumferential compression force on the electrical shielding wires/tape 20/22 and the cable jacket 24 that circumferentially surround the outer surface of contact post 150. This compression, in conjunction with the serrations, teeth or the like 152 on the outside surface of the contact post 150, result in an engaging or retention force that is applied to the coaxial cable 10 that meets SCTE requirements for connector pull-off as well as additional electrical, mechanical and environmental requirements. In addition, this engaging/retention force may also contribute toward a positive moisture seal at the cable-connector interface. An example of a prior art connector having the design of connector 100 is provided in U.S. Pat. No. 7,192,308.

FIG. 5 illustrates a second conventional compression style back-fitting coaxial "F" connector 200. As shown in FIG. 5, the connector 200 includes a tubular connector body 210, a compression sleeve 230, a contact post 250 and an internally threaded nut 270. The connector body 210 of connector 200 is shorter than is the connector body 110 of connector 100. Moreover, the compression sleeve 230 fits over the outside surface of the connector body 210. The compression sleeve 230 includes an annular internal element 242 that is designed to fit between the contact post 250 and the inside surface of the connector body 210 when the compression sleeve 230 is inserted axially into its seated (i.e., fully engaged or activated) position within the connector body 210. As a result, the annular internal element 242 may directly engage the shielding wires 22 and/or jacket 24 of a cable 10 that is inserted into and over the contact post 250 in the same manner that the main body of compression sleeve 130 of connector 100 engages a coaxial cable as is described above with reference to FIGS. 2-4. As such, similar to the connector 100 discussed above with respect to FIGS. 2-4, this second conventional connector 200 uses a sleeve 230 to contact and engage annular internal element 242 such that annular internal element 242 directly imparts a 360-degree circumferential compression on the contact post 250. This 360-degree circumferential compression imparts an engaging or retention force that meets SCTE requirements for connector pull-off and provides a moisture seal. An example of a prior art connector having the design of connector 200 is provided in U.S. Pat. No. 7,182,639.

FIGS. 6 and 7 illustrate a third conventional coaxial "F" connector 300. As shown in FIGS. 6 and 7, the connector 300 includes a tubular connector body 310, a compression sleeve 330, a contact post 350 and an internally threaded nut 370. The connector 300 further includes a reinforcing shield 380 that fits over a portion of the connector body 300. As shown in FIG. 7, the compression sleeve 330 fits over the outside diameter of the connector body 310. The outside radius of the connector body 310 may be slightly larger than the inside radius of a portion of the compression sleeve 330. A compression tool is used to force the compression sleeve 330 over the connector body 310, and in the process the connector body 310 deforms inwardly to assert a compression/retention force on the jacket 24 and electrical shielding wires/tape 20/22 of a coaxial cable 10 that is inserted into and over the contact post 350 in the same manner described above with reference to connector 100 of FIGS. 2-4. In this manner, the compression sleeve 330 is used to indirectly radially decrease the gap spacing between the underlying connector body 310 and the contact post 350. In particular, the compression sleeve 330 imparts a 360-degree circumferential compression on the tubular connector body 310 which, in turn, deforms to impart a circumferential compression on the outside components of the cable 10 and on the contact post 350. The resulting engaging or retention force may meet SCTE requirements for connector pull-off, and may also contribute to providing a positive moisture sealing at the cable-connector interface. An example of the prior art F-connector design of FIGS. 6-7 is provided in U.S. Pat. No. 7,255,598.

SUMMARY

Pursuant to embodiments of the present invention, reusable coaxial connectors are provided that include a connector body, a contact post that resides at least partly within the connector body, a compression sleeve that is configured to impart a compressive force to secure one or more elements of a coaxial cable between the connector body and the contact post when the compression sleeve is in a seated position, and an internally threaded rotatable nut that is attached to the connector body. The compression sleeve of these connectors includes a first recess on an external surface thereof that is configured to receive a first member of an extraction tool that is configured to move the compression sleeve from its seated position to an unseated position.

In some embodiments, the first recess may be an external groove in the compression sleeve. For example, the external groove may be an annular external groove. The compression sleeve may include a base portion and a distal portion that extends from the base portion, where the base portion of the compression sleeve has an external diameter that is greater than an external diameter of a distal portion of the compression sleeve. In some embodiments, the groove may be located in the base portion of such a compression sleeve. In other embodiments, the first recess may be at least first and second apertures in an external surface of the compression sleeve.

In some embodiments, the connector body may include a second recess that is configured to receive a second member of the extraction tool. In some embodiments, the second recess may be, for example, an external groove in the connector body. In other embodiments, the second recess may be at least first and second apertures in the connector body. In still other embodiments, the connector body may include one or more projections that are configured to receive a second member of the extraction tool.

Pursuant to further embodiments of the present invention, reusable coaxial connectors are provided that include a connector body, a contact post that resides at least partly within the connector body, a compression sleeve that is configured to impart a compressive force to secure one or more elements of a coaxial cable between the connector body and the contact post when the compression sleeve is in a seated position, and an internally threaded rotatable nut that is attached to the connector body. The compression sleeve of these connectors includes one or more projections that are configured to receive a first member of an extraction tool that is configured to move the compression sleeve from its seated position to an unseated position.

In some embodiments, the compression sleeve may include a base portion and a distal portion that extends from the base portion. The base portion of the compression sleeve may have an external diameter that is greater than an external diameter of a distal portion of the compression sleeve. In such embodiments, the one or more projections may be an annular ridge that projects from the base portion of the compression sleeve.

In some embodiments, the connector body may include a first recess that is configured to receive a second member of the extraction tool. This first recess may be, for example, a groove in the connector body or first and second apertures in the connector body. In some embodiments, the connector body may include one or more projections that are configured to receive a second member of the extraction tool.

Pursuant to further embodiments of the present invention, methods of reusing a coaxial connector that is installed on a first coaxial cable segment are provided. Pursuant to these methods, an extraction tool is used to unseat a compression sleeve of the coaxial connector from a seated position in which the compression sleeve and a connector body of the coaxial connector together secure one or more elements of the first coaxial cable segment within the coaxial connector. The coaxial connector may then be removed from the first coaxial cable segment. A second coaxial cable segment is inserted within the connector body. Then, a compression tool is used to forcibly insert the compression sleeve into the seated position so that the compression sleeve and connector body together secure one or more elements of the second coaxial cable segment within the coaxial connector.

In some embodiments, the compression tool and the extraction tool may be a single compression/extraction tool. In such embodiments, the compression/extraction tool may include a first member that is configured to engage the connector body of the coaxial connector and a second member that is configured to engage the compression sleeve of the coaxial connector. The compression sleeve may include a first recess, and the second member of the compression/extraction tool may be configured to be received within the first recess. The compression/extraction tool may impart a force on the compression sleeve that has a primary component in a direction that is generally parallel to a longitudinal axis of the connector body when unseating the compression sleeve of the coaxial connector from its seated position. In other embodiments, the extraction tool may include a first member that engages either the compression sleeve or the connector body and a second member that engages the other of the compression sleeve or the connector body. In such embodiments, the extraction tool may apply a force to at least one of the compression sleeve or the connector body that is sufficient to move the compression sleeve from its seated position to its unseated position.

Pursuant to still further embodiments of the present invention, extraction tools that are configured to move a compression sleeve of a coaxial connector from a seated position to an unseated position are provided. These extraction tools may include a first member that has a first mechanism for engaging a connector body of the coaxial connector and a second member that has a second mechanism for engaging the compression sleeve of the coaxial connector. These extraction tools may be configured to increase the separation between the first mechanism and the second mechanism in response to activation of an activation mechanism by an operator.

In some embodiments, the first mechanism may be a first pair of arms. In some embodiments, the activation mechanism may be a pair of handles that pivot about a pivot point. In other embodiments, the activation mechanism may be a single handle that is moved with respect to a body of the extraction tool. The extraction tool may also be configured to decrease the separation between the first mechanism and the second mechanism in response to activation of an activation mechanism by an operator such that the extraction tool may also operate as a compression tool.

DETAILED DESCRIPTION

Figure 1A:
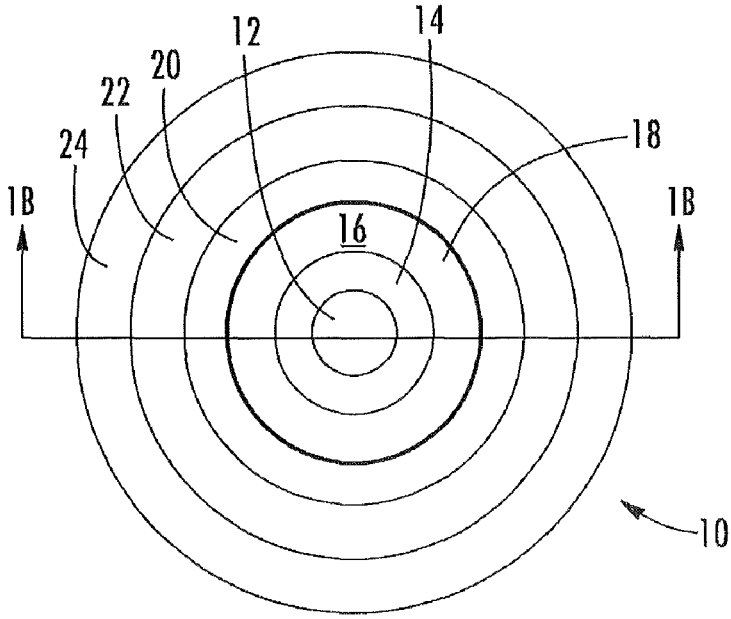
FIG. 1A (PRIOR ART)
FIGS. 1A and 1B are, respectively, a schematic transverse cross-sectional diagram and a schematic longitudinal cross-sectional diagram of a conventional coaxial cable.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the size of lines and elements may be exaggerated for clarity. It will also be understood that when an element is referred to as being "coupled," "connected" or "attached" to another element, it can be coupled, connected or attached directly to the other element, or intervening elements may also be present. In contrast, when an element is referred to as being "directly coupled," "directly connected" or "directly attached" to another element, there are no intervening elements present. The terms "upwardly", "downwardly", "front", "rear" and the like are used herein for the purpose of explanation only.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

Coaxial "F" connectors with compression style back fittings have been developed that include disengagement mechanisms that impart a reversible compressive, sealing and seizing force on a coaxial cable. In particular, U.S. patent application Ser. No. 12/327,355, filed Dec. 3, 2008, which is assigned to the assignee of the present application, discloses coaxial "F" connectors that include one or more of a variety of such disengagement mechanisms. These disengagement mechanisms allow the coaxial "F" connectors to be removed from a first coaxial cable and thereafter reused on a second coaxial cable. The entire contents of U.S. patent application Ser. No. 12/327,355 is incorporated herein by reference.

Pursuant to embodiments of the present invention, compression and extraction tools are provided that can be used to (1) force a compression style back fitting of a coaxial "F" connector into its seated position within or over the connector body in order to lock the connector onto a coaxial cable and (2) reversibly drive the compression style back fitting from its seated position to an unseated position that allows the connector to be removed from the cable for reuse on a second coaxial cable. In some embodiments, two separate tools may be provided: a first "compression" tool that is used to move the compression style backfitting into its seated position in the connector body in order to lock the connector onto the end of a coaxial cable; and a second "extraction" tool that is used to supply the opposite tensile force that is necessary to un-seat the compression sleeve so that the coaxial cable can be removed from the connector so that the connector may later be reused on another coaxial cable. In some cases, the "compression" tool could be one of a variety of prior art tools that are currently used in the art to seat compression style back-fittings of coaxial "F" connectors. In other embodiments of the present invention, a single tool may be provided that acts as both the compression and the extraction tool (herein a "compression/extraction tool").

Pursuant to further embodiments of the present invention, coaxial "F" connectors are provided that are designed to work with the above-mentioned compression and extraction tools. These coaxial connectors will meet the applicable SCTE standards for minimum axial tension pull-off or retention force, moisture migration and other environmental parameters when the connectors are installed on a coaxial cable. These coaxial "F" connectors may also designed so that components thereof will not be readily deformed. As such, the applicable SCTE standards may be met when the coaxial "F" connectors according to embodiments of the present invention are reused on a second or subsequent coaxial cable as well. It will be appreciated, however, that while the connectors according to embodiments of the present invention may be reused a reasonable number of times, with some embodiments, incremental wear may occur that may eventually render the connector unusable after a certain number of uses. The reusable coaxial "F" connectors according to embodiments of the present invention may be implemented with respect to, for example, all three types of prior art compression style back fitting coaxial "F" connectors described in the background section above.

Figure 8:
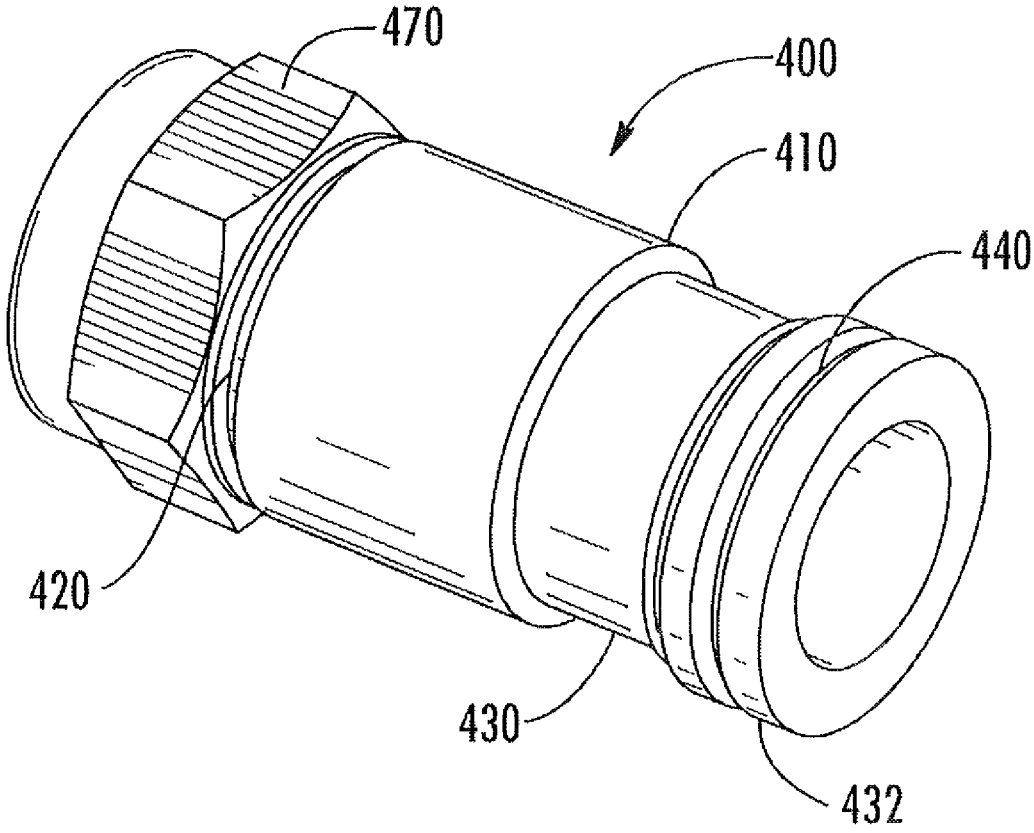
FIG. 8 is a perspective view of a coaxial "F" according to certain embodiments of the present invention.
Figure 9A:
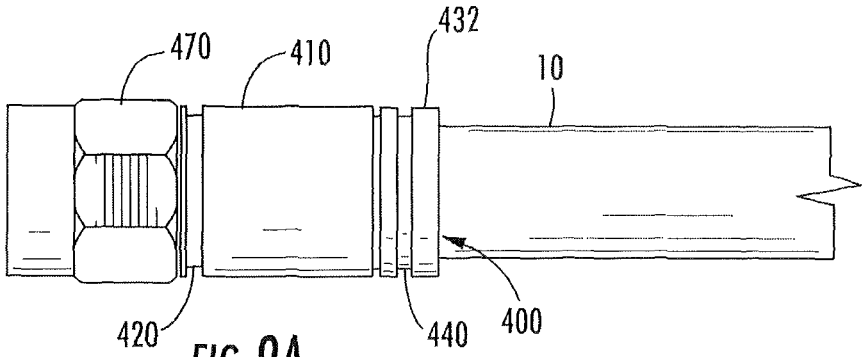
FIGS. 9A-9C are side views of the coaxial "F" connector of FIG. 8 in various states of assembly and positions.
Figure 9B:
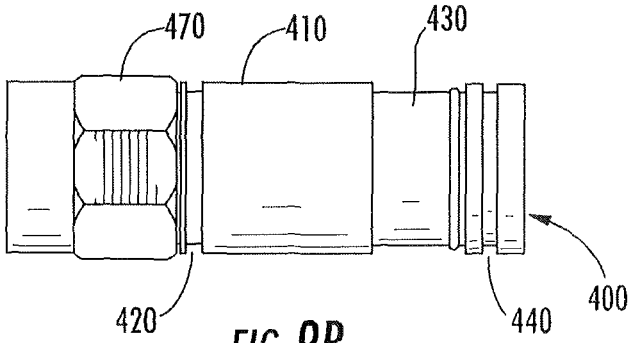
Figure 9C:
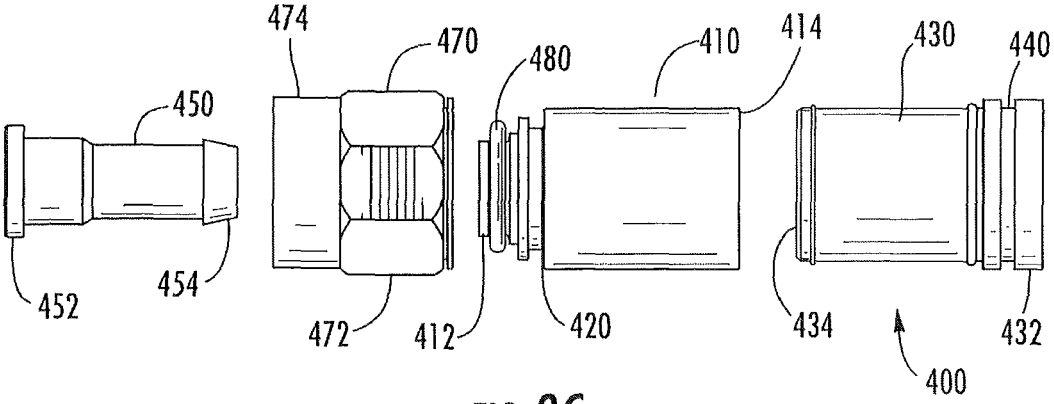

FIG. 8 is a perspective view of a coaxial "F" connector 400 according to first embodiments of the present invention. FIGS. 9A-9C are side views of the coaxial "F" connector 400. In particular, FIG. 9A illustrates the position of the compression sleeve 430 when the compression sleeve 430 has been moved into its seated position so as to lock a coaxial cable 10 within the connector 400. FIG. 9B illustrates how the connector 400 appears when the compression sleeve, 430 is in its unseated position, which is the position that the compression sleeve is typically in when it is shipped from the factory. FIG. 9C is an exploded side view that shows each of the individual components of connector 400 and how they fit together. Finally, FIG. 10 is a sectional view of the connector 400.

Figure 10:
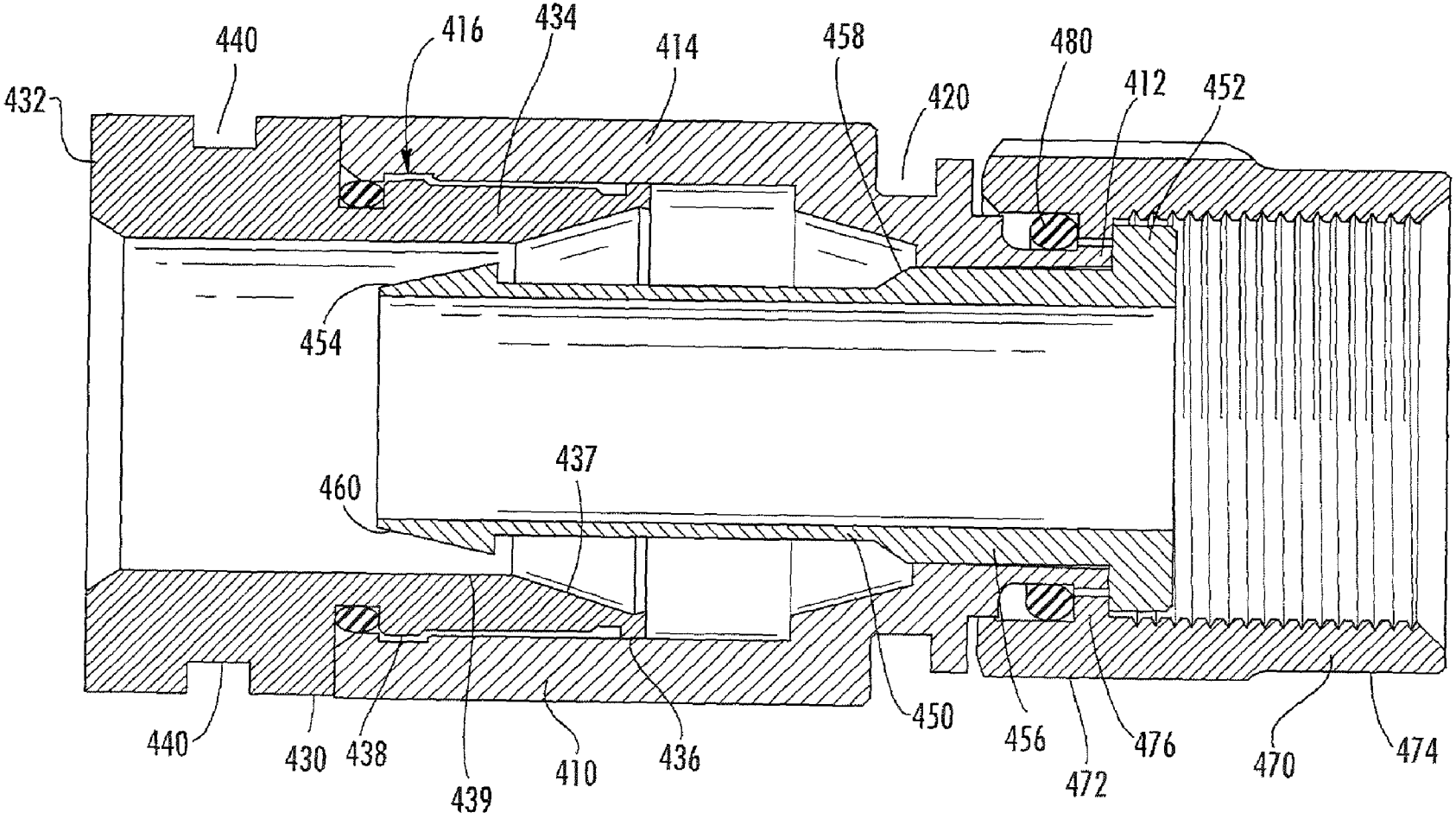
FIG. 10 is a sectional view of the coaxial "F" connector of FIG. 8.

As shown in FIGS. 8-10, the connector 400 includes a tubular connector body 410, a compression sleeve 430, a contact post 450 and an internally threaded nut 470. The connector body 410 includes a front end 412 and a rear end 414. The compression sleeve 430 includes a base 432 and a distal end 434. The contact post 450 includes a base 452 and a distal end 454. The distal end 454 of the contact post 450 has a smaller external diameter than a middle portion 456 of the contact post 450. A ramped transition section 458 connects the middle portion 456 to the distal end 454. The distal end 454 may include one or more serrations, teeth, lips or the like. In the depicted embodiment, one serration 460 is provided on the distal end 454 of the contact post 450. The nut 470 includes a base 472 that has a hexagonal cross-section, and a lip 474 that extends from the base 472. An O-ring or other type of seal 480 may be provided at the interface between the connector body 410 and the nut 470 to provide an enhanced moisture seal (see FIG. 9C).

The connector 400 is assembled by inserting the distal end 454 of contact post 450 into the end of the nut 470 that includes the lip 474. The base 452 of the contact post 450 has an external diameter that exceeds the internal diameter of an annular ridge 476 that is provided in the interior of nut 470 (see FIG. 10). Thus, the contact post 450 will rest within nut 470 such that the base 452 of the contact post 450 directly contacts the annular ridge 476 in the interior of nut 470. The front end 412 of connector body 410 is inserted into the other end of nut 470 (i.e., the base end 472). An opening in the front end 412 of the connector body 410 has a diameter that is less than the diameter of a central portion 456 of the contact post 450. In some embodiments, the front end 412 of connector body 410 is first inserted into the base end 472 of nut 470. Then, the distal end 454 of contact post 450 is inserted into the lip end 474 of the nut 470. As the contact post 450 is inserted, the distal end 454 may fit cleanly through the opening in the front end 412 of the connector body 410. As it is inserted further, eventually the ramped transition portion 458 of the contact post 450 contacts the front end 412 of the connector body 410. As the ramped transition portion 458 has a larger external diameter, it contacts the connector body 410 and pushes against the interior of the front end 412 of the connector body 410, thereby enlarging the opening in the front end 412 as the contact post 450 is inserted further into the connector body 410. Eventually, the entirety of the ramped transition portion 458 slides within the opening in the front end 412 of the connector body 410, and the middle portion 456 of the contact post 450 is fully received within the opening. The middle portion 456 of the contact post 450 exerts an outward radial force on the front end 412 of the connector body 410 that presses the front end 412 against the interior of the base 472 of nut 470, thereby locking the contact post 450 and the connector body 410 within the nut 470.

The distal end 434 of the compression sleeve 430 is mounted within the rear end 414 of the connector body 410. FIG. 9A illustrates the position of the compression sleeve 430 when the compression sleeve 430 has been moved into its seated position so as to lock a coaxial cable 10 within the connector 400. In this position, the base 432 of the compression sleeve 430 may, for example, directly contact the rear end 414 of the connector body 410. FIG. 9B, on the other hand, illustrates how the connector 400 appears when the compression sleeve 430 is in its unseated position. In this position, the base 432 of the compression sleeve 430 is spaced apart from the rear end 414 of the connector body 410. Referring to FIG. 10, the connector body 410 may include an annular groove 416 and the compression sleeve 430 may include a first annular ridge 436. The first annular ridge 436 may be received within the annular groove 416 in order to hold the compression sleeve 430 in place within the connector body 410 when the compression sleeve 430 is in its unseated position of FIG. 9B. The first annular ridge 436 and the mating groove 416 thus provide a mechanism for maintaining the connector 400 as a single piece unit before a cable 10 is to be attached to the connector 400 (i.e., when the connector 400 is shipped from the factory). The first annular ridge 436 and the mating groove 416 may be designed to apply only a small retention force in the forward axial direction (i.e., the direction of movement in which the compression sleeve 430 is moved from its unseated position to its seated position) so that the compression sleeve 430 may be readily moved into the position of FIG. 9A when terminating a cable 10 with the connector 400. The compression sleeve 430 may further include a second annular ridge 438 that mates with the groove 416 in order to lock the compression sleeve 430 in place in its seated position of FIGS. 9A and 10 within the connector body 410.

In some embodiments, the first annular ridge 436 and the annular groove 416 may be designed to provide only a small retention force in both the forward and reverse axial directions so that the compression sleeve 430 may be readily removed completely from the connector body 410. FIG. 10 illustrates such an embodiment (note that the first annular ridge 436 is quite small), and shows the compression sleeve 430 in its seated position where the second annular ridge 438 is within the annular groove 416. In other embodiments, the first annular ridge 436 and the annular groove 416 may be designed to provide a large retention force in the reverse axial direction so that the compression sleeve 430 may not be readily moved beyond its unseated position within the connector body 410, and hence cannot readily be removed without damaging the connector 400. This can be accomplished, for example, by increasing the size of both the first annular ridge 436 and the depth of the annular groove 416, and by designing the edges of the first annular ridge 436 and the annular groove to resist further axial movement of the compression sleeve 430 out of the connector body 410.

Figure 1B:
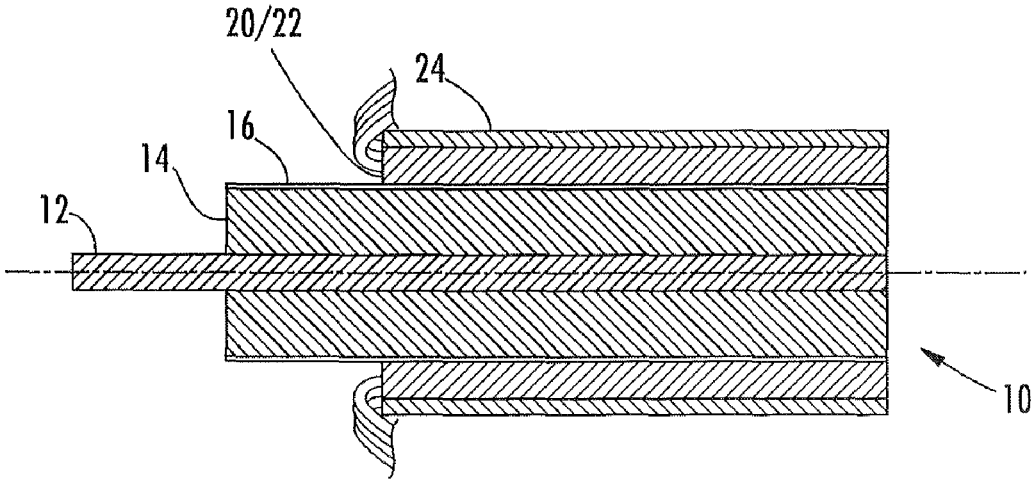
FIG. 1B (PRIOR ART)
Figure 2:
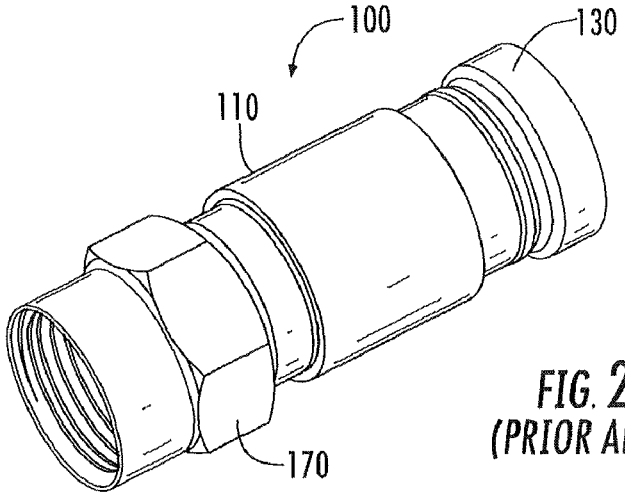
FIG. 2 (PRIOR ART)
FIG. 2 is a perspective view of a prior art coaxial "F" connector that has a compression style back fitting with the compression sleeve in a unseated position.
Figure 3:
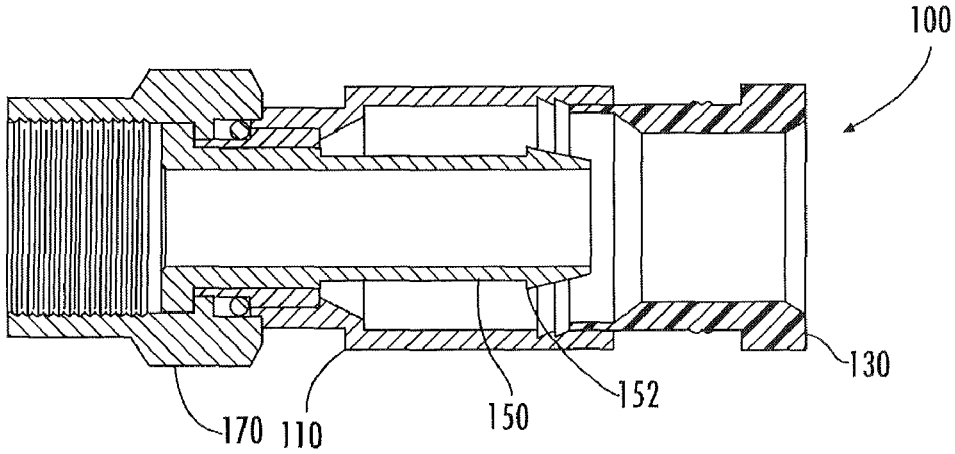
FIG. 3 (PRIOR ART)
FIG. 3 is a side cross-sectional view of the prior art coaxial "F" connector of FIG. 2.
Figure 4:
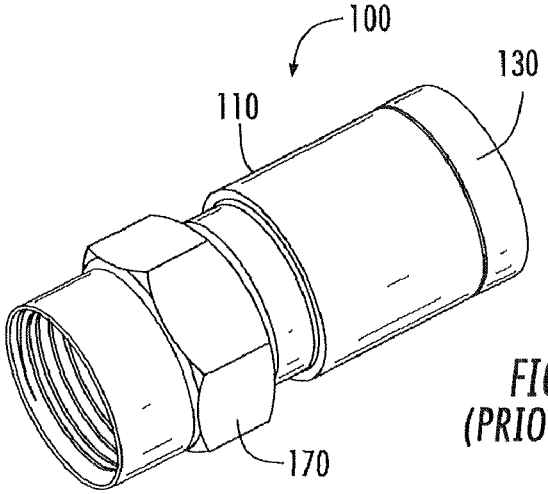
FIG. 4 (PRIOR ART)
FIG. 4 is a perspective view of the prior art coaxial "F" connector of FIG. 2 with the compression sleeve in a seated position.
Figure 5:
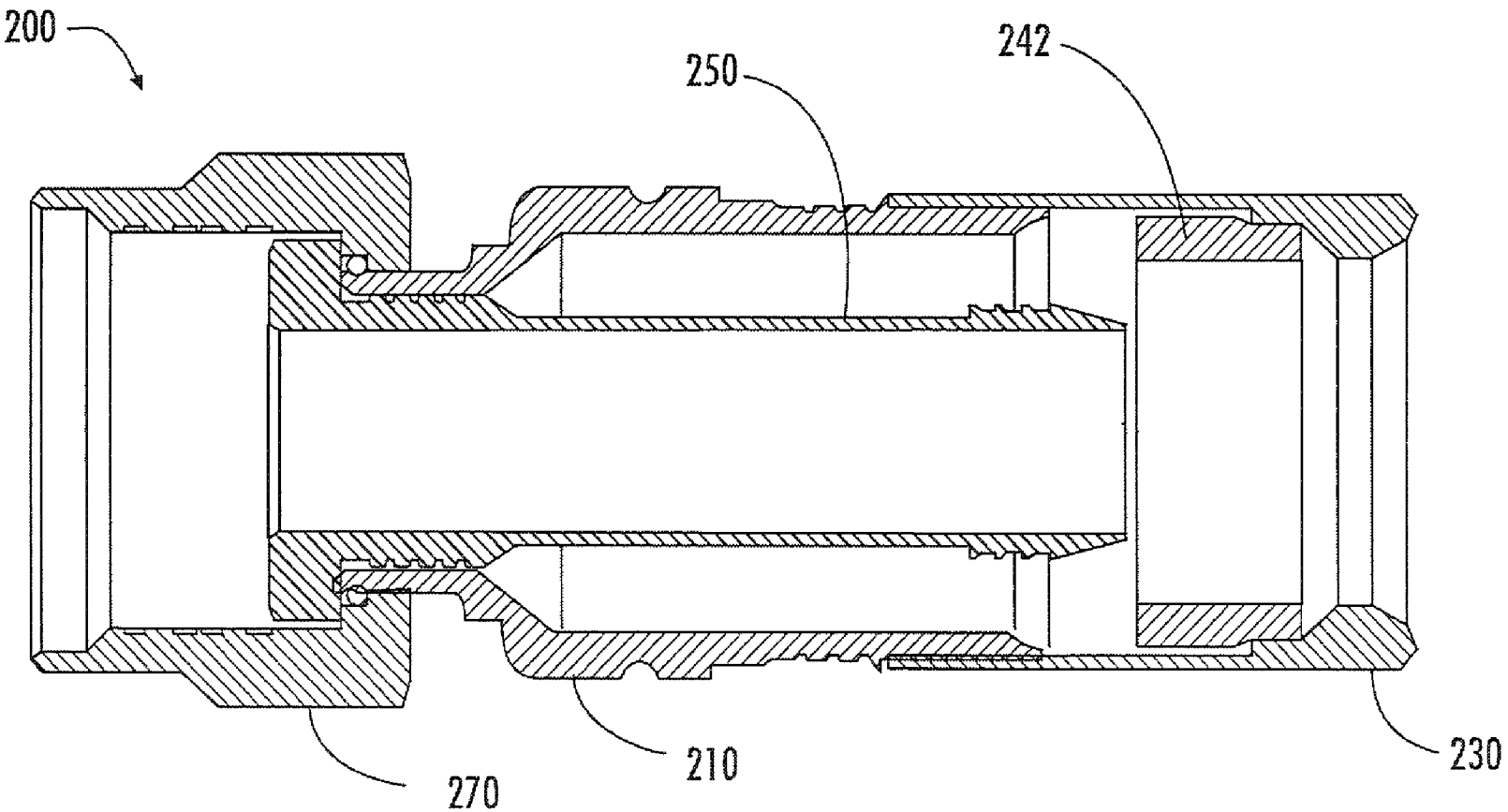
FIG. 5 (PRIOR ART)
FIG. 5 is a side cross-sectional view of another prior art coaxial "F" connector.
Figure 6:
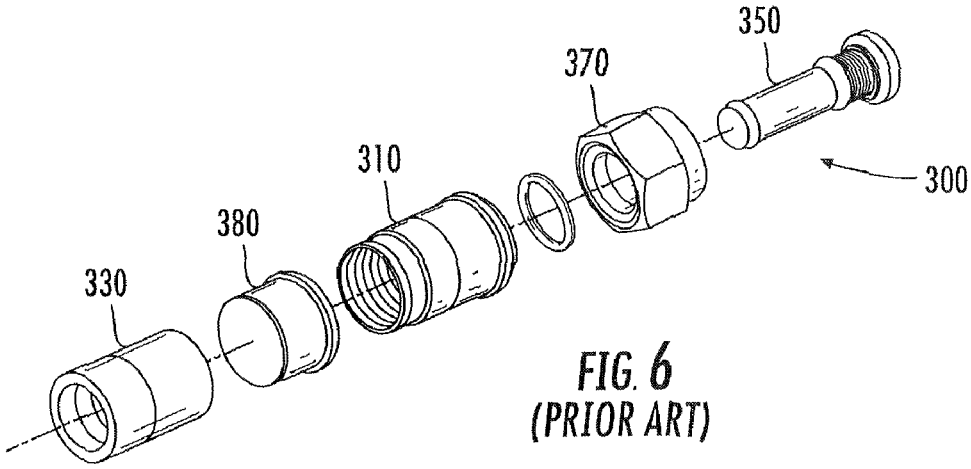
FIG. 6 (PRIOR ART)
FIG. 6 is an exploded perspective view of yet another prior art coaxial "F" connector that has a compression style back fitting.
Figure 7:
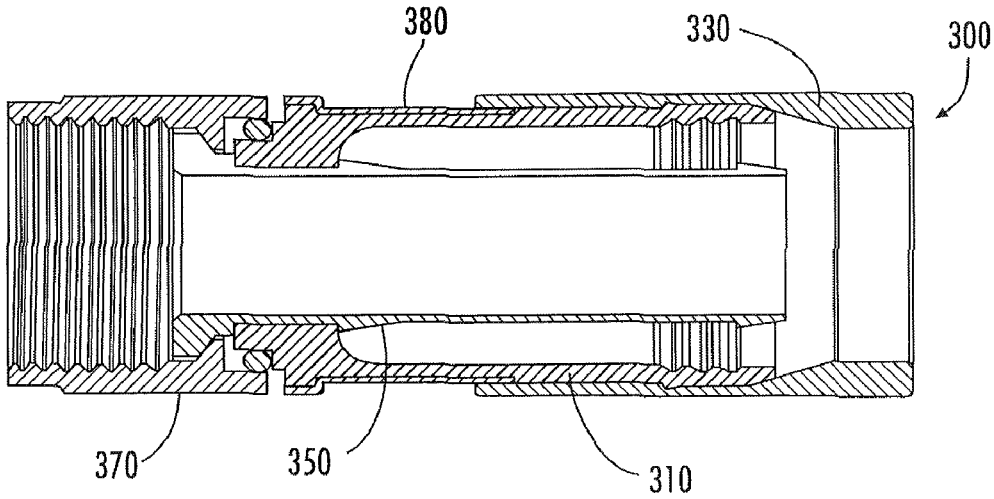
FIG. 7 (PRIOR ART)
FIG. 7 is a side cross-sectional view of the prior art coaxial "F" connector of FIG. 6 after it is assembled.

In order to terminate the connector 400 onto the end of a coaxial cable 10, the cable 10 is first prepared. FIG. 1B depicts how the coaxial cable 10 may be prepared before the cable 10 is inserted into a coaxial "F" connector. As shown in FIG. 1B, end portions of the dielectric 14, the tape 16 that is preferably bonded to the dielectric 14, the electrical shielding wires 20, any electrical shielding tape 22 and the cable jacket 24 are cut away and removed so that the end portion of the central conductor 12 is fully exposed. Next, an additional end portion of the cable jacket 24 is removed. There are commercially available preparation tools that will produce all of the appropriately dimensioned cuts in one operation. One such tool is an SDT series tool available from Ripley Tools. Then, the end portions of the electrical shielding wires 20 are flared or folded back in whole or in part over the remainder of the cable 10.

The prepared cable 10 is then axially inserted into the compression sleeve 430, and the compression sleeve 430 with the cable 10 therein is inserted into the connector body 410. The core 18 of the cable 10 is axially inserted within the inner diameter of the contact post 450, and the electrical shielding wires/tape 20/22 and the cable jacket 24 are inserted over the outside surface of the contact post 450. During this insertion process, the connector 400 may be in the assembly state shown in FIG. 9B. The exposed length of the central conductor 12 core is sufficient such that it will extend all the way through the connector 400 and extend into the internally threaded nut 470 of the connector 400 as the male contact protrusion of the connector 400.

The compression sleeve 430 may be designed so that when it is fully inserted within the connector body 410, a gap will exist between the distal end 434 of the compression sleeve 430 and the front end 412 of the connector body 410. The flared or folded back portions of the electrical shielding wires 20 are forced into the well that is defined by this gap when the compression sleeve 430 is compressively forced into the connector body 410. The distal end 434 of the compressive sleeve 430 may exert an additional retention force on the electrical shielding wires 20 that fill this gap. This retention force may be increased even further by the serration 460 on the distal end 454 of the contact post 450. In addition, the flared/folded back portion of the electrical shielding wires 20 contacts the metal connector body 410, thereby advantageously grounding the electrical shielding wires 20.

Next, a compression tool may be used to fully insert the compression sleeve 430 into the connector body 410 so that the connector 400 assumes the position of FIG. 9A. Typically, the compression tool is designed to exert an axial force on the compression sleeve 430 relative to the longitudinal axis of the connector body 410 that drives the distal end 434 of the compression sleeve 430 from its unseated position into its seated position within the connector body 410. As shown in FIG. 10, the distal end 434 of the compression sleeve 430 may have a larger inner diameter than does a middle portion 439 and the base 432 of the compression sleeve 430. A ramped transition section 437 may connect the inner diameter of the distal end to the inner diameter of the middle portion 439 and base 432 of the compression sleeve 430.

As the compression sleeve 430 is axially driven into the connector body 410, the gap between the inside diameter of the compression sleeve 430 and the jacket 24 of the cable 10 is reduced and ultimately disappears as the middle portion 439 of the compression sleeve 430 (i.e., the portion with the reduced internal diameter that is next to the ramped transition section 437) is forced over the cable jacket 24 (note that the cable 10 is not depicted in FIG. 10 to simplify the drawing). Thus, once the compression sleeve 430 is fully inserted and seated within the connector body 410, the compression sleeve 430 imparts a generally 360-degree compression force on the jacket 24 and the underlying shielding wires 20 and any tape 22.

Several forces may hold the cable 10 in place within the connector 400. First, as noted above, the annular ridge 438 is received within the annular groove 416 when the compression sleeve 430 is in its seated position. As the external diameter of the annular ridge 438 is greater than the internal diameter of the connector body 410 on either side of the annular groove 416, an axial force is necessary to pop the annular ridge 438 on compression sleeve 430 out of the annular groove 416 on connector body 410 in order to remove the compression sleeve 430 from the connector body 410. Second, the internal surface of the compression sleeve 430 imparts a radially-directed force on the cable jacket 24 that compresses the cable jacket 24 onto the contact post 450, as the thickness of the cable jacket 24 and braiding 20 and optional shielding tape 22 exceeds the spacing between the interior of the compression sleeve 430 and the exterior surface of the contact post 450 when the compression sleeve 430 is in its seated position. This compressive force likewise must be overcome in order to withdraw the compression sleeve 430 back to its unseated position. Third, the distal end 454 of the contact post 450 may include one or more teeth or serrations 460. Once the compression sleeve 430 has been forced into its seated position, the barbed ends of these teeth or serrations 460 may press or cut into the braiding wires 20/22, optional shielding tape 22, and jacket 24, thereby creating an area where the spacing between the contact post 450 and the interior of the compression sleeve 430 is reduced further. In this region, the contact post 450 and compression sleeve 430 exert even greater forces on the cable jacket 24 and braiding wires 20 that act to hold the cable 10 in place within the connector 400, and the braiding wires 20 and cable jacket 24 may deform about the back edge of the serration 460. Thus, each of the above forces acts to hold the cable 10 in place within the connector 400, and to provide a moisture-proof seal that resists the ingress of water into the interior of the connector 400.

As noted above, the connectors according to embodiments of the present invention may be removed from a first cable 10 and then subsequently used on another cable 10 (or on a second section of the first cable 10). In particular, various extraction tools may be used to apply a force on the compression sleeve that is sufficient to move the compression sleeve from its seated position to an unseated position. In some embodiments, the connectors may include special features that facilitate using these extraction tools to unseat the compression sleeve.

For example, the base 432 of the compression sleeve 430 of the connector 400 of FIGS. 8-10 includes an annular groove 440 in the exterior surface thereof. The connector body 410 may likewise include an annular groove 420 in an exterior surface thereof. An extraction tool such as the extraction tools discussed herein may include first and second arms, fingers, nubs, plates or other surfaces that fit within the annular grooves 440 and 420. The extraction tool may then be activated to apply a generally axial force to one or both of the connector body 410 and the compression sleeve 430 that moves the compression sleeve from its seated to its unseated position. In this manner, the coaxial connectors according to embodiments of the present invention comprise reusable coaxial connectors that can be installed on a first coaxial cable and then later be removed from the first coaxial cable for reuse on a second coaxial cable. In some embodiments, the annular grooves 420 and 440 may have the same widths (as measured along the longitudinal axis of the connector).

Figure 11:
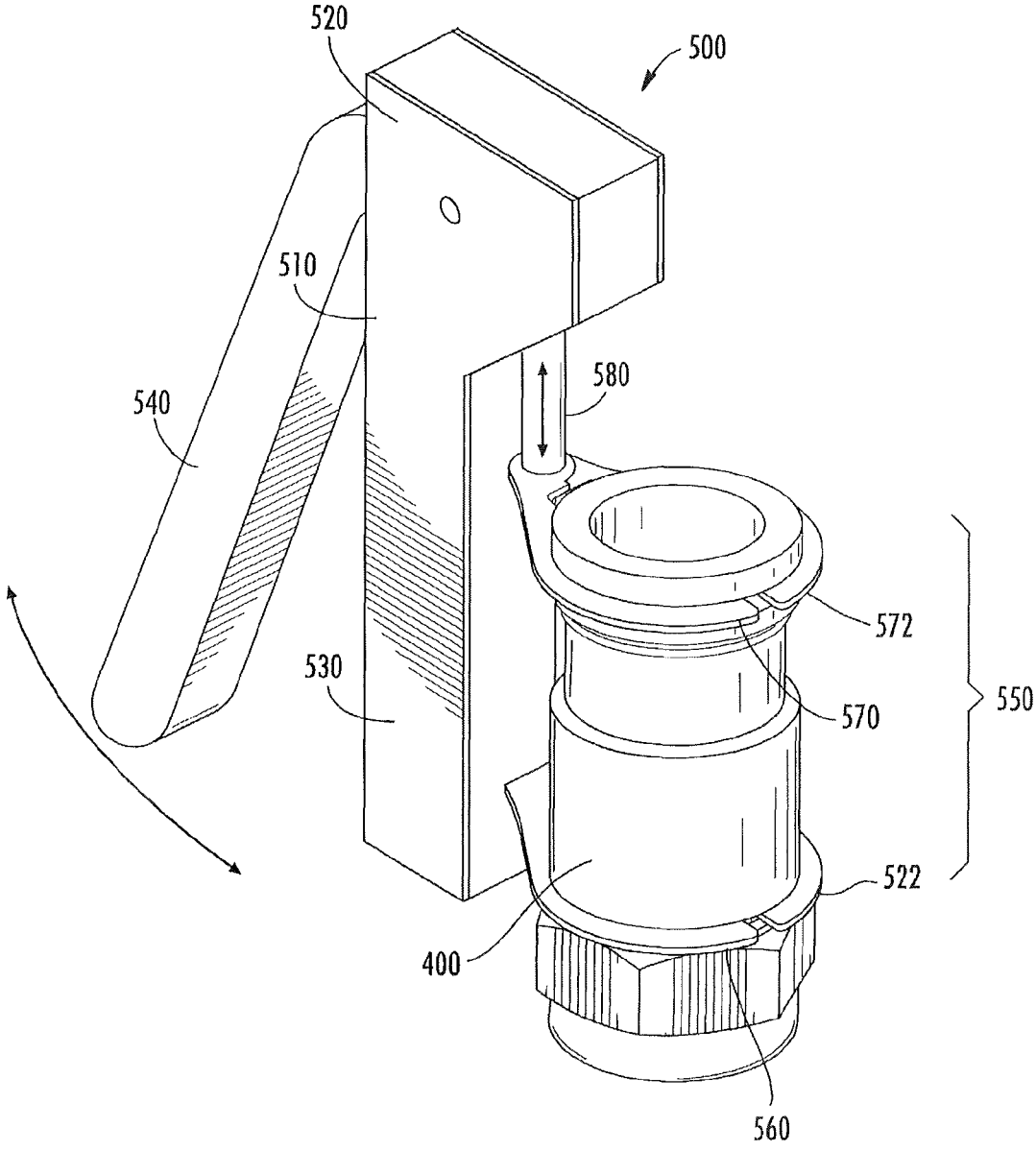
FIG. 11 is a perspective view of a compression/extraction tool according to certain embodiments of the present invention.
Figure 12A:
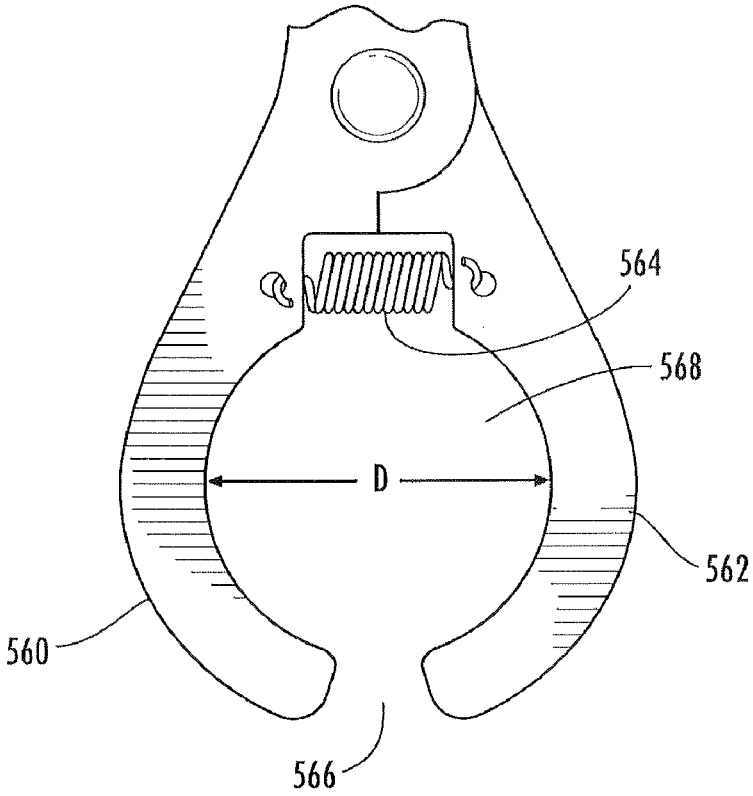
FIGS. 12A and 12B are top views of two different possible implementations for the first pair of arms of the compression/extraction tool of FIG. 11.
Figure 12B:
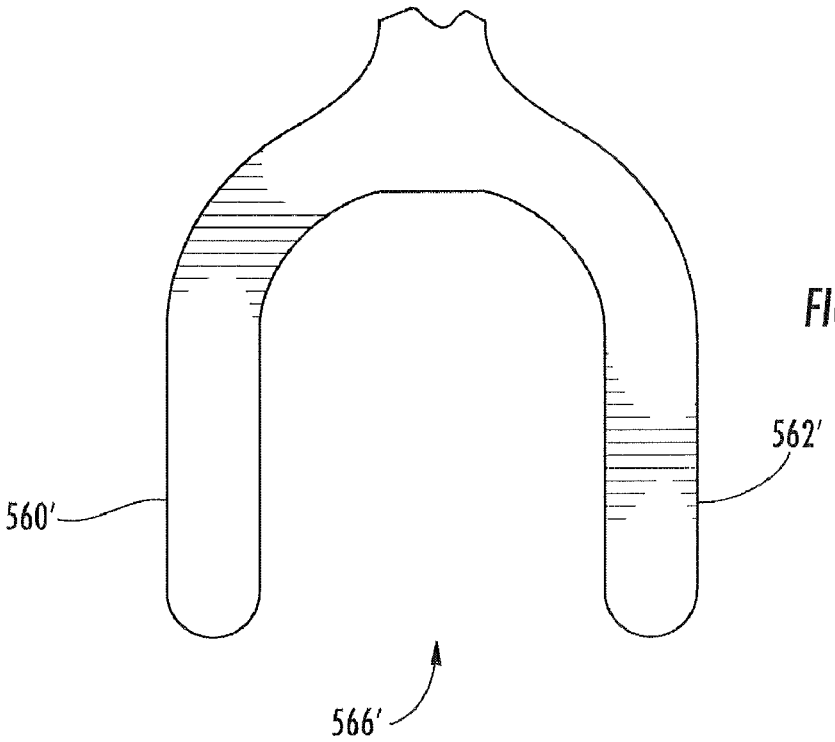

FIG. 11 is a perspective view of a compression/extraction tool 500 according to embodiments of the present invention that may be used to seat and/or unseat the compression sleeves of coaxial connectors according to embodiments of the present invention such as, for example, coaxial connector 400. FIGS. 12A and 12B are top views of two exemplary implementations of a first pair of arms of the compression/extraction tool 500 that are used to engage a coaxial connector.

As shown in FIG. 11, the compression/extraction tool 500 includes a body 510, a lever 540 and a connector engaging mechanism 550. The body 510 has a base 520 and a handle 530 extending therefrom. The handle 530 may extend from the base 520 along a first vertical axis (when the tool 500 is positioned as shown in FIG. 11). The lever 540 extends from the base 520, and may define an acute angle with the handle 530. The connector engaging mechanism 550 may comprise a multi-part mechanism that includes a first pair of first and second arms 560, 562 and a second pair of third and fourth arms 570, 572. The first pair of arms 560, 562 may extend horizontally from a lower portion of the handle 530, and may be used to engage, for example, the connector body of a coaxial connector. The second pair of arms 570, 572 may extend horizontally from a cylinder 580 that extends downward in the vertical direction from the base 520. The second pair of arms 570, 572 may be used to engage, for example, the compression sleeve of the coaxial connector.

As shown in FIG. 12A, in some embodiments, the first arm 560 and the second arm 562 may each be generally crescent-shaped so that each arm may be received within half of an annular groove in, for example, the connector body of a coaxial connector that the tool 500 is used on. In these embodiments, the first pair of arms 560, 562 may be spring loaded, for example, by a spring 564 to be biased toward a closed (or partly closed) position. In such embodiments, the maximum distance "D" between each of the arms 560, 562 when the arms 560, 562 are in their closed position may be less than or equal to the diameter of the circles defined by the annular grooves in the connector body. The spring 564 biases the arms 560, 562 to return to this normally resting position, but allows the arms 560, 562 to move farther apart so as to be forced onto the connector body of the connector that the tool 500 is being used on. The distal ends of the arms 560, 562 may also define an opening 566 therebetween.

In operation, the distal ends of arms 560, 562 may be forced against the annular groove in the connector body of a coaxial connector (e.g., groove 420 in connector body 410 of connector 400). As the operator forces the arms 560, 562 against the annular groove in the connector body, the arms 560, 562 are pushed apart as the force overcomes the bias of the spring 564, thereby enlarging the opening 566 sufficiently such that the portion of the connector body that includes the annular groove can be received through the opening 566 into the cavity 568 that is defined between the arms 560, 562. As the connector body is received within the cavity 568, the spring 564 biases the arms 560, 562 towards their normally resting position such that the arms 560, 562 will be fully received within the annular groove in the connector body and will together firmly grasp the connector body. Once the compression or extraction operation (see description below) is completed, the operator may remove the connector body from the arms 560, 562 by pulling the connector body through the opening 566 between the arms 560, 562.

The second pair of arms 570, 572 may be identical to the first pair of arms 560, 562, and may operate in the same fashion as described above on, for example, an annular groove in the compression sleeve of the connector (e.g., annular groove 440 of compression sleeve 430 of connector 400). Accordingly, further description of the configuration and operation of the second pair of arms 570, 572 will be omitted. It will be appreciated, however, that the first and second pairs of arms 560, 562; 570, 572 may be configured differently, may define circles having different diameters, may have different spring-loading mechanisms, may omit the spring loading mechanism, may be designed to engage apertures, cavities, projections or the like on the coaxial connector that are different than an annular groove, etc. Moreover, it will also be appreciated that, in other embodiments, one or both of the first and second pair of arms 560, 562; 570, 572 could be replaced with other structures that are used to grasp respective components of the coaxial connector. Thus, it will be appreciated that the arms 560, 562; 570, 572 illustrate one exemplary embodiment, and are not intended to be limiting.

By way of example, FIG. 12B illustrates a first pair of arms 560', 562' that could be used in place of the first pair of arms 560, 562 (and/or in place of the second pair of arms 570, 572). As shown in FIG. 12B, the arms 560', 562' together define a U-shaped element. An installer may insert, for example, groove 420 in connector body 410 into the opening 566' defined by the arms 560', 562'. The use of arms 560', 562' provides a simpler tool that may be easier to use.

Referring back to FIG. 11, the tool 500 may be used to seat a compression sleeve in a coaxial connector, such as the coaxial connector 400, as follows. First, the end of the coaxial cable 10 that is to receive the coaxial connector 400 is prepared in the manner discussed above and shown in FIG. 1B. This prepared end of the coaxial cable 10 is then inserted into the base of the compression sleeve 430 when the compression sleeve 430 is in its unseated position within the coaxial connector 400. Next, the operator inserts the annular groove 420 in the connector body 410 into the first pair of arms 560, 562 and the annular groove 440 in the compression sleeve 430 into the second pair of arms 570, 572 as discussed above. Then, the operator compresses the lever 540 towards the handle 530. As the lever 540 moves, a mechanical linkage or other mechanism (not shown in the figures) that may be located, for example, in the base 520 exerts a force on the cylinder 580 that moves the cylinder 580 downward in the vertical direction. When this occurs, the force on the cylinder 580 is applied to the bulkhead that defines the annular groove 440 in the compression sleeve 430, and this force drives the compression sleeve 430 downwardly into the connector body 410, thereby moving the compression sleeve 430 into its seated position so as to install the coaxial connector 400 onto the coaxial cable 10. The operator may then remove the coaxial connector 400 from the tool 500 by disengaging the connector 400 from the first and second pairs of arms 560, 562; 570, 572 in the manner described above.

As noted above, the tool 500 may also be used to unseat the compression sleeve of a coaxial connector such as coaxial connector 400 so that a coaxial cable 10 can be removed and the coaxial connector 400 then reused on another coaxial cable. This extraction operation may be accomplished as follows. First, the operator inserts the annular groove 420 in the connector body 410 into the first pair of arms 560, 562 and the annular groove 440 in the compression sleeve 430 into the second pair of arms 570, 572 in the manner described above. Then, the operator pulls the lever 540 away from the handle 530. As the lever 540 moves, the mechanical linkage or other mechanism (not shown in the figures) that is located in the base 520 exerts a force on the cylinder 580 that moves the cylinder 580 upward in the vertical direction. When this occurs, the force on the cylinder 580 is applied to the bulkhead that defines the annular groove 440 in the compression sleeve 430, and this force pulls the compression sleeve 430 upwardly, thereby moving the compression sleeve 430 from its seated position to its unseated position in the connector body 410. Once the compression sleeve is in this position, the operator may pull on the coaxial cable 10 to remove the coaxial cable 10 from the connector 400. The operator may then remove the coaxial connector 400 from the tool 500 by disengaging the connector 400 from the first and second pairs of arms 560, 562; 570, 572 in the manner described above, and the connector 400 is then available for reuse on another coaxial cable. In some embodiments, the tool 500 may be designed so that the lever 540 may only be moved a distance that is sufficient to move the cylinder 580 a distance that pulls the compression sleeve 430 from its seated to its unseated position.

Figure 13:
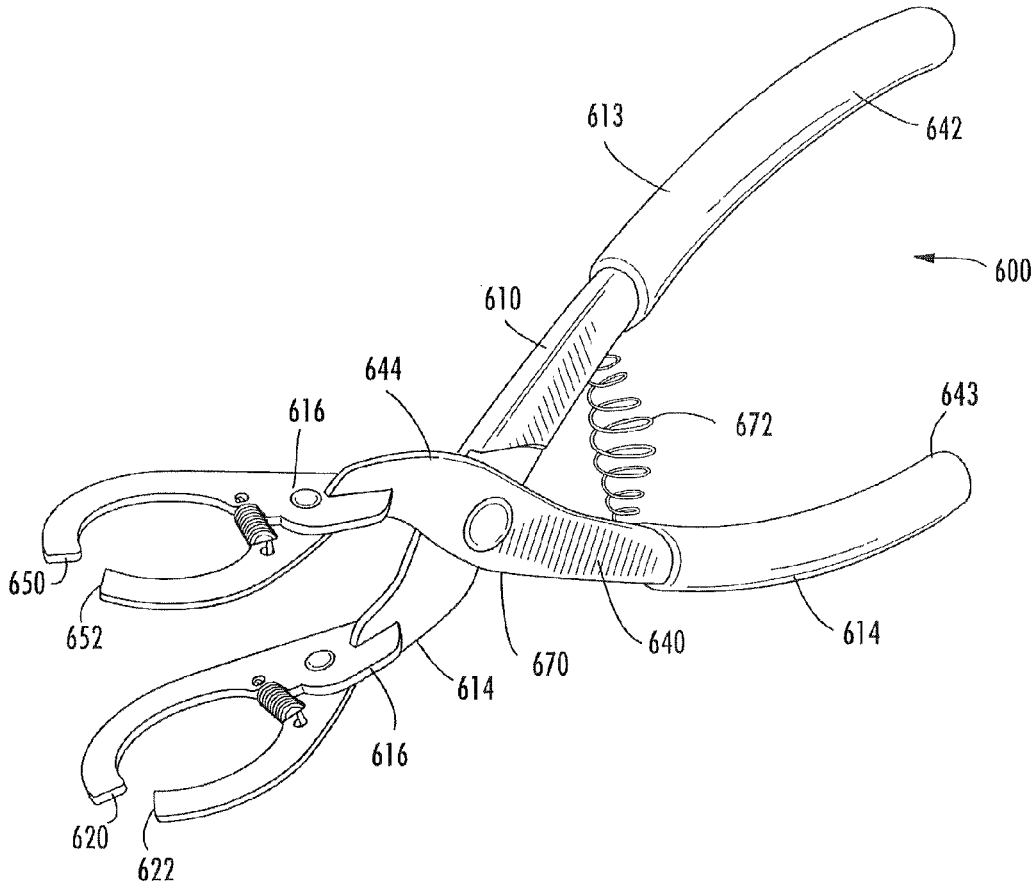
FIG. 13 is a perspective view of a compression/extraction tool according to further embodiments of the present invention.

FIG. 13 is a perspective view of a compression/extraction tool 600 according to further embodiments of the present invention that may be used to seat and/or unseat the compression sleeves of coaxial connectors according to embodiments of the present invention such as, for example, coaxial connector 400.

As shown in FIG. 13, the compression/extraction tool 600 may comprise a specially designed pair of mechanically advantaged pliers. The tool 600 includes first and second elongated members 610 and 640 that are joined together by a rivet 670. The elongated members 610, 640 may be identical to each other in some embodiments. A base portion of each member 610, 640 acts as respective first and second handles 612, 642 for the pliers 600. A cushioned handle piece 613, 643 may be provided on each respective base portion 610, 640. A spring 672 may extend between the base portions 612, 642. The spring 672 may bias the handles 612, 642 so that the pliers normally rest in an open position. The distal end of each member 610, 640 form first and second jaws 614, 644 that operate as a pair of jaws.

The first and second jaws 614, 644 include respective first and second rectangular plates 616, 646. A first pair of arms 620, 622 extends from the first rectangular plate 616, and a second pair of arms 650, 652 extends from the second rectangular plate 646. Each pair of arms 620, 622 and 650, 652 may comprise spring-loaded arms, and may be substantially identical to the arms 560, 562 described above with respect to the compression/extraction tool 500 of FIGS. 11-12. As with the tool 500, the first pair of arms 620, 622 may be used to engage one of the connector body or the compression sleeve of a coaxial connector, and the second pair of arms 650, 652 may be used to engage the other of the connector body or the compression sleeve of the coaxial connector. As the pairs of arms 620, 622 and 650, 652 may operate in the same fashion as the pairs of arms 560, 562 and 570, 572 described above with respect to the tool 500, further description of the arms 620, 622; 650, 652 will be omitted. It will likewise be appreciated that the pairs of arms 620, 622; 650, 652 are exemplary in nature, and that pursuant to further embodiments of the present invention, the first and second pairs of arms may be configured differently or may be replaced with other structures that are used to grasp respective components of the coaxial connector. For example, the arms 560', 562' illustrated in FIG. 12B could be used to implement arms 620, 622 and/or 650, 652.

The tool 600 may be used to move a compression sleeve of a coaxial connector from its unseated to its seated position in order to mount the connector on the end of a coaxial cable as follows. In particular, the following discussion describes how the tool 600 may be used to mount the coaxial connector 400 that is described above on the end of a coaxial cable 10.

First, the end of the coaxial cable 10 that is to receive the coaxial connector 400 is prepared in the manner discussed above and shown in FIG. 1B. This prepared end of the coaxial cable 10 is then inserted into the base of the compression sleeve 430 when the compression sleeve 430 is in its unseated position.

Next, the operator inserts the annular groove 420 in the connector body 410 into the first pair of arms 620, 622 and the annular groove 440 in the compression sleeve 430 into the second pair of arms 650, 652 in the manner described above. Then, the operator pushes the handles 612, 642 together. As the handles 612, 642 come together, the distal end of each member 610, 640 rotates about the pivot point formed by rivet 670, thereby bringing the jaws 614, 644 closer together. As the connector body 410 and the compression sleeve 430 are held by the first and second pairs of arms 620, 622; 650, 652, respectively, that extend from each jaw 614, 644, this movement acts to drive the compression sleeve 430 further into the connector body 410. If sufficient force is applied to the handles 612, 642, the compression sleeve 430 may be moved from its unseated position within the connector body 410 into its seated position, at which point the coaxial connector 400 will be firmly mounted onto the end of coaxial cable 10. The operator may then remove the coaxial connector 400 from the tool 600 by disengaging the connector 400 from the first and second pairs of arms 620, 622; 650, 652 in the manner described above.

The tool 600 may likewise be used to move the compression sleeve 430 from its seated position to its unseated position within the connector body 410 so that the coaxial connector 400 can be removed from the coaxial cable 10 for reuse on another coaxial cable. This extraction operation may be accomplished as follows. First, the operator squeezes the handles 612, 642 together so that the jaws 614, 644 align with the annular grooves 420, 440 in the connector body 410 and the compression sleeve 430, respectively, and then inserts the annular groove 420 in the connector body 410 into the first pair of arms 620, 622 and the annular groove 440 in the compression sleeve 430 into the second pair of arms 650, 652. Then, the operator pulls the handles 612, 642 apart. When this occurs, the first pair of arms 620, 622 applies a force in a first direction on the connector body 410 and the second pair of arms 650, 652 applies a second force that is generally opposite the first force on the compression sleeve 430, and these forces move the compression sleeve 430 out of its seated position and into its unseated position. Once the compression sleeve 430 is in the unseated position, the operator may pull on the coaxial cable 10 to remove the coaxial cable 10 from the connector 400. The operator may then remove the coaxial connector 400 from the tool 600 by disengaging the connector 600 from the first and second pairs of arms 620, 622; 650, 652, and the connector 400 is then available for reuse on another coaxial cable.

As should be clear from the above discussion, connectors according to embodiments of the present invention may use any conventional contact post and internally-threaded nut. The compression sleeve of each connector according to embodiments of the present invention includes a first engaging surface that may mate with a first member of an extraction tool such as the first pair of arms 560, 562 of tool 500 or the first pair of arms 620, 622 of tool 600. The connector body (or alternatively the nut or another component) includes a second engaging surface that may mate with a second member of the extraction tool, such as the second pair of arms 570, 572 of tool 500 or the second pair of arms 650, 652 of tool 600. At least one of the first or second members is a moveable member. The extraction tool (or a compression/extraction tool, when used in an extraction operation), when activated, moves one or both of the first and second members along an axis that is generally parallel to the longitudinal axis of the connector. If both the first and second members move, they will move in generally opposite directions. The extraction tool imparts sufficient force on one or both of the compression sleeve and connector body in order to unseat the compression sleeve from its seated position so that the coaxial cable may be removed from the connector.

Figure 14:
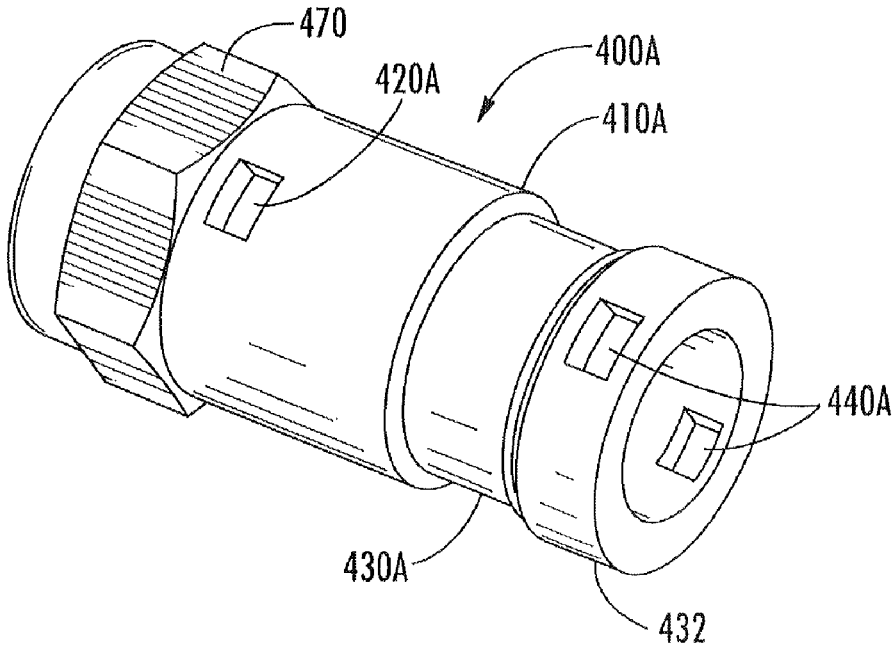
FIGS. 14-18 are perspective views of modified versions of the coaxial "F" connector of FIGS. 8-10 according to further embodiments of the present invention.

FIG. 14 is a perspective view of a coaxial connector 400A that is a modified version of the connector 400 described above. The connector 400A may be identical to the connector 400, except that the compression sleeve 430 is replaced with a compression sleeve 430A, and the connector body 410 is replaced with a connector body 410A. As shown in FIG. 14, the compression sleeve 430A is identical to the compression sleeve 430 of FIGS. 8-10, except that the annular groove 440 of compression sleeve 430 is replaced with a pair of apertures 440A. Likewise, the connector body 410A is identical to the connector body 410 of FIGS. 8-10, except that the annular groove 420 of connector body 410 is replaced in connector body 410A with a pair of apertures 420A (only one of the apertures 420A is visible in FIG. 14; the other aperture 420A may be identical to the depicted aperture and may be located on the opposite side of the connector body 410A). The connector 400A may operate in substantially the same manner as the connector 400 operates, with the only difference being that the first and second members of the extraction tool include protrusions that fit within the apertures 420A, 440A, respectively, instead of members that fit within the annular grooves 420, 440.

Figure 15:
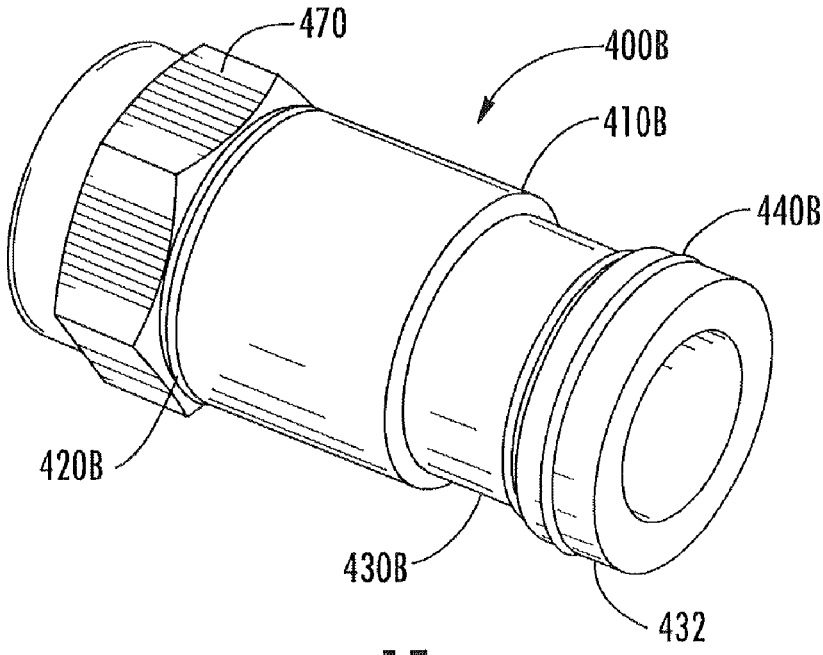

FIG. 15 is a perspective view of a coaxial connector 400B that is a modified version of the connector 400 described above. The connector 400B may be identical to the connector 400, except that the compression sleeve 430 is replaced with a compression sleeve 430B, and the connector body 410 is replaced with a connector body 410B. As shown in FIG. 15, the compression sleeve 430B is identical to the compression sleeve 430 of FIGS. 8-10, except that the annular groove 440 of compression sleeve 430 is replaced with an annular ridge 440B. Likewise, the connector body 410B is identical to the connector body 410 of FIGS. 8-10, except that the annular groove 420 of connector body 410 is replaced with an annular ridge 420B in connector 400B. The connector 400B may operate in substantially the same manner as the connector 400, with the only difference being that each arm of the first pair of arms on the first member of the extraction tool includes an internal annular groove that is configured to receive the annular ridge 440B of the compression sleeve body 430B, and each arm of the second pair of arms on the second member of the extraction tool includes an internal annular groove that is configured to receive the annular ridge 420B of the connector body 410B.

Figure 16:
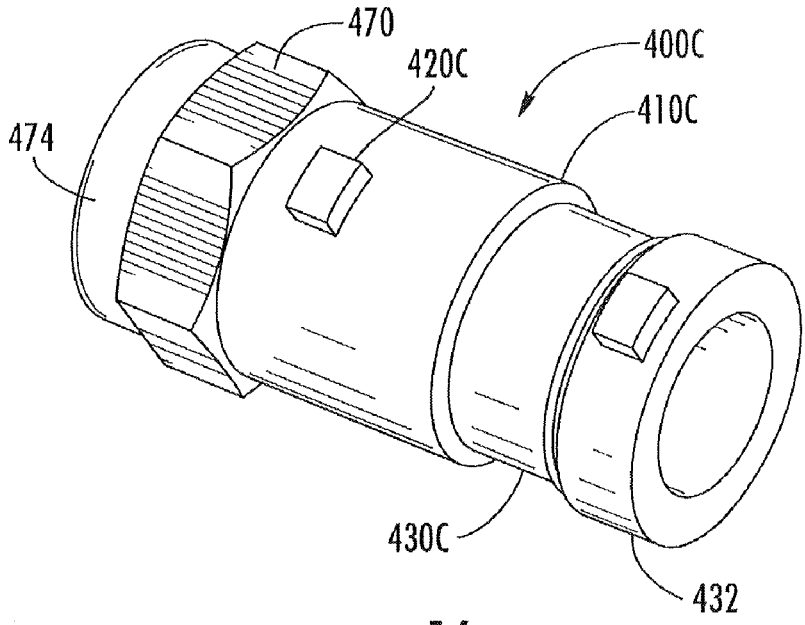

FIG. 16 is a perspective view of a coaxial connector 400C that is a modified version of the connector 400A described above. The connector 400C may be identical to the connector 400A, except that the compression sleeve 430A is replaced with a compression sleeve 430C, and the connector body 410A is replaced with a connector body 410C. As shown in FIG. 16, the compression sleeve 430C is identical to the compression sleeve 430A of FIG. 14, except that the annular groove 440A of compression sleeve 430A is replaced with a pair of projections 440C (only one of the projections 440C is visible in FIG. 16; the other projection 440C may be identical to the depicted projection and may be located on the opposite side of the compression sleeve 430C). Likewise, the connector body 410C is identical to the connector body 410A of FIG. 14, except that the annular groove 420A of connector body 410A is replaced with a pair of projections 420C (only one of the projections 420C is visible in FIG. 16; the other protrusion 420C may be identical to the depicted projection and may be located on the opposite side of the connector body 410C). The connector 400C may operate in substantially the same manner as the connector 400A operates, with the only difference being that the first and second members of the extraction tool include apertures that fit within the projections 420C, 440C.

Figure 17:
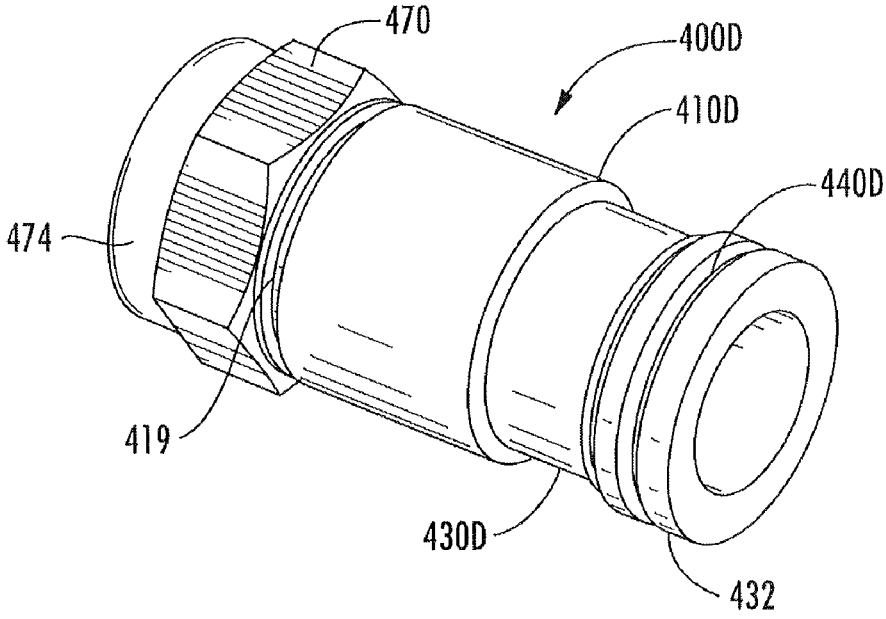

FIG. 17 is a perspective view of a coaxial connector 400D that is a modified version of the connector 400 described above. The connector 400D may be identical to the connector 400, except that connector body 410 is replaced with a connector body 410D. As shown in FIG. 17, the connector body 410D may be a conventional connector body that does not include the annular groove 420 of connector body 410. The connector 400D may operate in substantially the same manner as the connector 400 operates, with the only difference being that the second member of the extraction tool is designed to hold the connector by engaging the lip 474 of the internally threaded nut 470 during the compression operation, and to hold the connector by engaging a narrowed "neck" portion 419 of the connector body 410D during the extraction operation. In particular, as the lip 474 has a smaller external diameter than does the portion of nut 474 that has the hexagonal external cross-section, the second member of the extraction tool may be designed to be a fixed member that engages the lip 474.

Referring now to FIGS. 11-12 and 17, operations will discussed that may be performed to move the compression sleeve 430 of coaxial connector 400D to its seated position using the compression/extraction tool 500. First, an operator inserts the annular groove 440 in the compression sleeve 430 into the second pair of arms 570, 572. The operator then inserts the lip 474 of nut 470 into the second pair of arms 570, 572. The second pair of arms holds the nut end of the connector 400D stationary. Then, the operator compresses the lever 540 towards the handle 530 to activate the mechanical linkage in the base 520 of tool 500 so as to exert a force on the cylinder 580 that moves the cylinder 580 downward in the vertical direction. The downward movement of the cylinder 580 applies a force to the bulkhead that defines the annular groove 440 in the compression sleeve 430, and this force drives the compression sleeve 430 downwardly into the connector body 410, thereby moving the compression sleeve 430 into its seated position so as to install the coaxial connector 400 onto the coaxial cable 10. The operator may then remove the coaxial connector 400 from the tool 500 by disengaging the connector 400 from the first and second pairs of arms 560, 562; 570, 572.

The compression sleeve 430 of coaxial connector 400D may subsequently be moved from its seated position to its unseated position using the compression/extraction tool 500 as follows so that the coaxial cable 10 can be removed and the coaxial connector 400D for reuse on another coaxial cable. First, the operator inserts the annular groove 440 in the compression sleeve 430 into the second pair of arms 570, 572 and inserts the narrowed neck portion 419 of the connector body 410D into the first pair of arms 560, 562. Then, the operator pulls the lever 540 away from the handle 530 to activate the mechanical linkage in the base 520 in order to exert a force on the cylinder 580 that moves the cylinder 580 upward in the vertical direction. When this occurs, the force on the cylinder 580 is applied to the bulkhead that defines the annular groove 440 in the compression sleeve 430, and this force urges the compression sleeve 430 in the upward direction. As the first pair of arms 560, 562 is engaging the narrowed neck portion 419 of the connector body 410D, the connector body 410D is held stationary. Consequently, the upward force applied by cylinder 580 on the bulkhead that defines the annular groove 440 acts to pull the compression sleeve 430 upwardly, thereby moving the compression sleeve 430 from its seated position to its unseated position in the connector body 410D. Once the compression sleeve 430 is in the unseated position, the operator may pull on the coaxial cable 10 to remove the coaxial cable 10 from the connector 400. In this embodiment, the connector body 410D preferably has a robust mechanical connection with the nut 470 and the contact post 450 that can withstand the forces that the second member of the extraction tool places on the interface of the nut 470 and the connector body 410D during the extraction operation.

Figure 18:
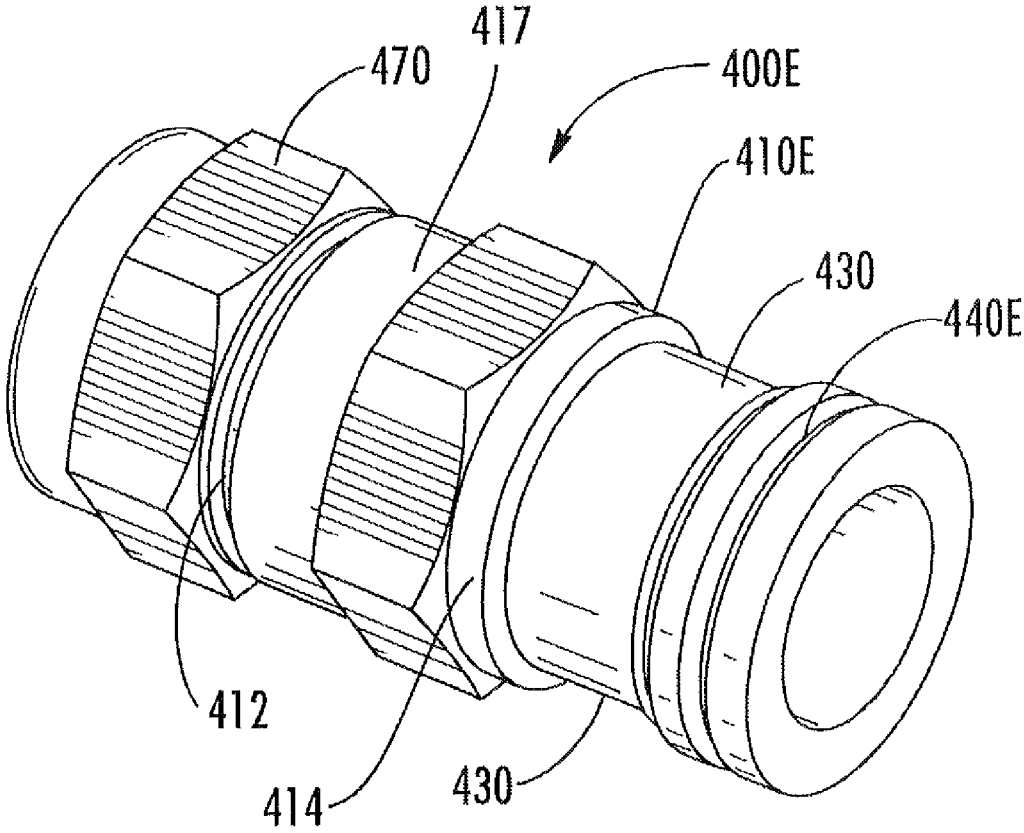

FIG. 18 is a perspective view of a coaxial connector 400E that is a modified version of the connector 400 described above. The connector 400E may be identical to the connector 400, except that connector body 410 of connector 400 is replaced with a connector body 410E. As shown in FIG. 18, the connector body 410E may be a conventional connector body that includes a nut portion 417. The connector 400E may operate in substantially the same manner as the connector 400D operates, with the only difference being that the second member of the extraction tool is designed to hold the connector by being placed around the connector body 410E on either side of the nut portion 417 during the compression and extraction operations. In particular, during the compression operation, the second pair of arms of the compression/extraction tool may be placed around the front end 412 of the connector body 410E, such that the nut 417 is forced against the second pair of arms during the compression operation. During the extraction operation, the second pair of arms of the compression/extraction tool may be placed around the rear end 414 of the connector body 410E, such that the second member exerts a force on the opposite side of nut 417 during the extraction operation.

As described above, the coaxial connectors according to embodiments of the present invention include compression sleeves that may be moved a seated position within the body of the coaxial connector to an unseated position. As such, after the connectors according to embodiments of the present invention have been installed on a first coaxial cable (or portion thereof), they can thereafter be removed from the first coaxial cable and reused on a second coaxial cable (or a second section of the first coaxial cable). As described above, various extraction tools according to embodiments of the present invention are provided that may be used to exert an axial force on the compression sleeve and/or connector body that is sufficient to disengage the compressive retention and sealing forces that are described above that may hold the compression sleeve in its seated position within the connector body. Once these forces are overcome, the compression sleeve may be partially or fully backed out of the connector body to be in the unseated position. Once in the unseated position, the coaxial cable on which the connector is installed may be removed from the connector. As the connectors according to embodiments of the present invention are designed to be unseated without excessively deforming or damaging any parts thereof during the compression and extraction operations, the connectors may thereafter be reused.

In connectors 400 and 400A-400E which are described above, the compression sleeve 430 inserts axially into the inside diameter of the tubular connector body 410. However, it will be appreciated that, in other embodiments of the present invention, the coaxial connectors may have compression sleeves that may be inserted axially over the outside diameter of the connector body so as to (1) directly impart a circumferential force on the contact post or to (2) indirectly impart a circumferential force on the contact post by imparting a compressive force on the connector body.

Figure 19:
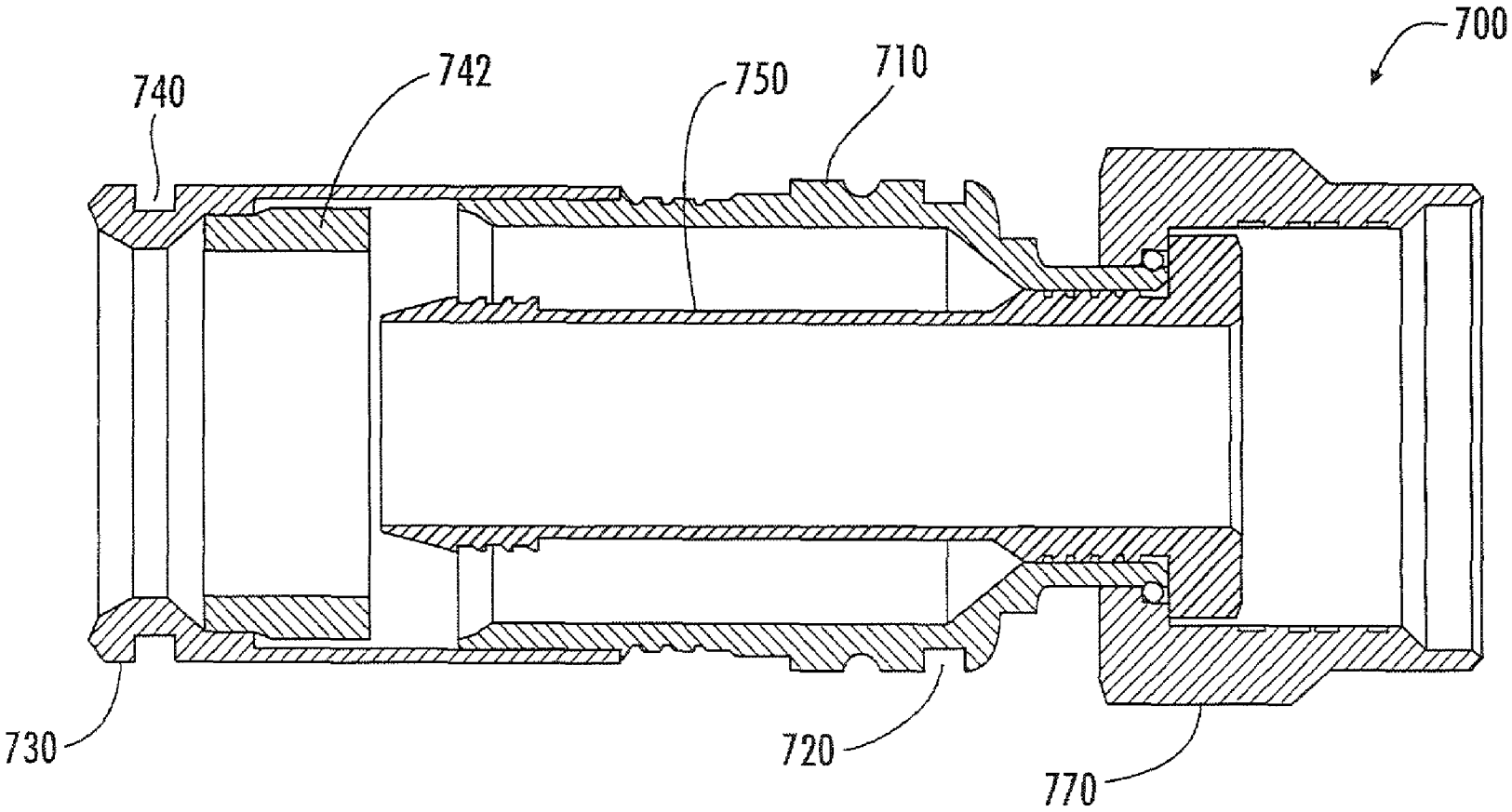
FIGS. 19-20 are cross-sectional views of coaxial "F" connectors according to further embodiments of the present invention that include external compression sleeves.

By way of example, FIG. 19 is a cross-sectional view of a coaxial connector 700 according to further embodiments of the present invention. As shown in FIG. 19, the connector 700 includes a connector body 710, a compression sleeve 730, a contact post 750 and an internally threaded nut 770. The compression sleeve 730 fits over the outside surface of the connector body 710, and includes an annular internal element 742 that fits between the contact post 750 and the inside surface of the connector body 710 when the compression sleeve 730 is inserted axially into its seated position within the connector body 710. The annular internal element 742 engages the shielding wires 22 and/or jacket 24 of a cable 10 (not shown in FIG. 19) to directly impart a 360-degree circumferential compression on the contact post 750.

As is also shown in FIG. 19, the connector body 710 includes an annular groove 720, and the compression sleeve 730 includes an annular groove 740. These annular grooves 720, 740 may be essentially identical to the annular grooves 420, 440 of the connector 400 described above with reference to FIGS. 8-10. The compression extraction/tools 500 and 600 of FIGS. 11-13 can be used to engage the annular groove 720 in the connector body 710 and the annular groove 740 in the compression sleeve 730 in the exact same manner, described above, that they engage the annular grooves 420 and 440 of connector 400. Thus, the compression/extraction tools 500 and 600 may be used to move the compression sleeve 730 over the connector body 710 (and the annular internal element within the connector body 710) into its seated position, and to likewise reverse the compressive sealing forces and move the compression sleeve 730 back to its unseated position so that the connector 700 may be removed from a coaxial cable.

Figure 20:
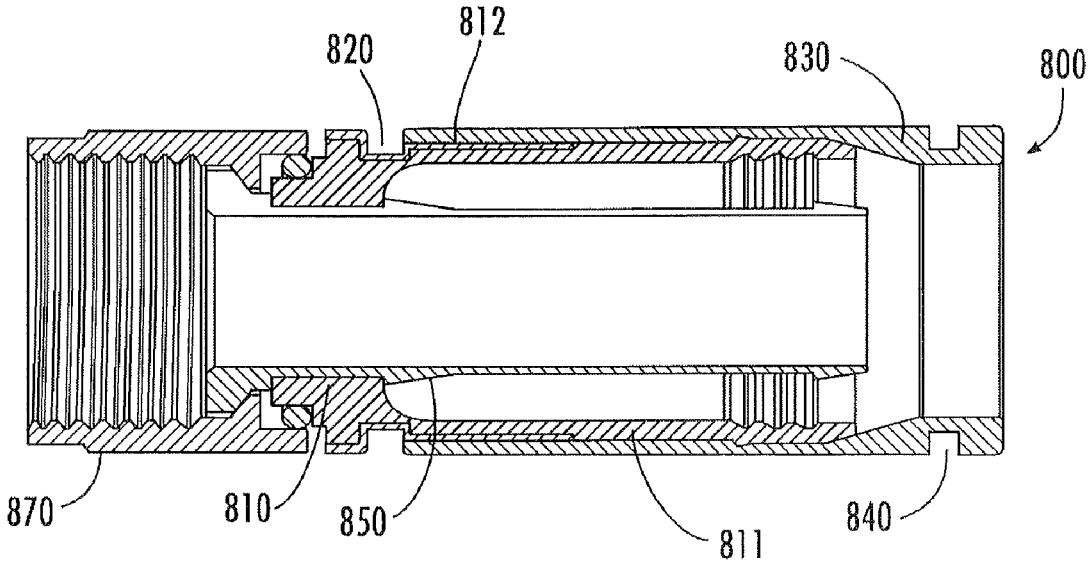

FIG. 20 is a cross-sectional diagram of illustrates another coaxial "F" connector 800 according to embodiments of the present invention. As shown in FIG. 20, the connector 800 includes a connector body 810, a compression sleeve 830, a contact post 850 and an internally threaded nut 870. In this particular embodiment, the connector body 810 comprises a two part body that includes a main body 811 and a reinforcing shield 812. As shown in FIG. 20, the compression sleeve 830 fits over the outside diameter of the connector body 810. The outside radius of the connector body 810 is slightly larger than the inside radius of the distal end of the compression sleeve 830. As such, when compression sleeve 830 is forced over the connector body 810, the connector body 810 deforms inwardly to assert a compression/retention force on the jacket 24 and electrical shielding wires/tape 20/22 of a coaxial cable 10 that is inserted into and over the contact post 850 and thereby seal the connector 800 onto the end of the coaxial cable 10.

As is also shown in FIG. 20, the connector body 810 includes an annular groove 820, and the compression sleeve 830 includes an annular groove 840. These annular grooves 820, 840 may be essentially identical to the annular grooves 720, 740 of the connector 700 described above with reference to FIG. 20, and the compression extraction/tools 500 and 600 of FIGS. 11-13 can be used in the same manner discussed above to engage the annular grooves 820, 840 in order to seat or unseat the compression sleeve 830 with respect to the connector body 810.

FIGS. 19 and 20 illustrate two coaxial connectors according to embodiments of the present invention that include external compression sleeves. Each of these exemplary connectors uses annular grooves on the compression sleeve and connector body as the mechanisms which the compression/extraction tools can use to engage the connector during compression and extraction operations. However, it will be appreciated that the alternative mechanisms 420A-E and 440A-E discussed above with respect to the coaxial connectors 400A-E may alternatively be used on either of the connectors 700 or 800 in place of the mechanisms 720, 740 and 820, 840.

It will be appreciated that the connector bodies described herein may be any housing or body piece that receives an end of a coaxial cable that is to be attached to the connector. It will likewise be appreciated that the compression sleeves described herein may be implemented as any sleeve that is configured to be received within or over top of a connector body in order to impart a generally circumferential compressive force on an end of a coaxial cable that is received within the compression sleeve. The contact posts described herein may be any post or other structure within the connector that receives the coaxial cable either within and/or on the post.

While in embodiments of the present invention first and second annular ridges 436, 438 and an annular groove 416 are provided on the compression sleeves 400, 400A-E, it will be appreciated that in other embodiments the annular ridges may be provided on the inside body of the connector body and the annular groove may be provided on the compression sleeve. It will likewise be appreciated that retention mechanisms other than mating annular ridges and grooves may be used. For example, raised projections may be provided on one of the compression sleeve or the inside diameter of the connector body that mate with recesses on the other of the compression sleeve or the inside diameter of the connector body. It will be appreciated that many other retention mechanisms may be used.

It will be appreciated that many modifications may be made to the exemplary embodiments of the present invention described above without departing from the scope of the present invention. By way of example, while the above-described connectors include separate connector bodies and contact posts, it will be appreciated that in other embodiments the connector body and contact post of a coaxial connector can be implemented together as a one-piece unit that performs the above-described functions of the connector body and contact post. It will likewise be appreciated that other components of the coaxial connectors described above may be combined into a single piece (e.g., the internally threaded nut and the connector body could be combined) and/or that some of the components may be implemented as multi-part components (e.g., the connector body may comprise multiple parts).

Many different embodiments have been disclosed herein, in connection with the above description and the drawings. It will be understood that it would be unduly repetitious and obfuscating to literally describe and illustrate every combination and sub-combination of these embodiments. Accordingly, the present specification, including the drawings, shall be construed to constitute a complete written description of all combinations and sub-combinations of the embodiments described herein, and of the manner and process of making and using them, and shall support claims to any such combination or sub-combination.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A reusable coaxial connector, comprising:

a connector body that is configured to have a first coaxial cable terminated therein, the connector body further configured so as to be reusable by having a second coaxial cable terminated therein subsequent to use of the connector body on the first coaxial cable;

a contact post that resides at least partly within the connector body;

a compression sleeve that is positioned at least partly within the connector body, wherein the compression sleeve is configured to impart a compressive force to secure one or more elements of a coaxial cable between the connector body and the contact post when the compression sleeve is in a seated position; and an internally threaded rotatable nut that is attached to the connector body, wherein the compression sleeve includes a first recess on an external surface thereof that is configured to receive a first member of an extraction tool that is configured to move the compression sleeve from its seated position to an unseated position.

2. The coaxial connector of claim 1, wherein the compression sleeve includes a base having a first external diameter and a distal end that is received within the connector body that has a second diameter that is less than the first diameter, and wherein the first recess comprises an external groove in the base of the compression sleeve.

3. The coaxial connector of claim 2, wherein the external groove comprises an annular external groove.

4. The coaxial connector of claim 1, wherein the first recess comprises at least first and second apertures in an external surface of the compression sleeve.

5. The coaxial connector of claim 1, wherein the connector body includes a second recess on an external surface thereof that is configured to receive a second member of the extraction tool, the second recess being accessible from an exterior of the coaxial connector.

6. The coaxial connector of claim 5, wherein the second recess comprises an external annular groove in the connector body.

7. The coaxial connector of claim 5, wherein the second recess comprises at least first and second apertures in the connector body.

8. The coaxial connector of claim 1, wherein the connector body includes one or more projections that are configured to receive a second member of the extraction tool.

9. The coaxial connector of claim 1 in combination with the extraction tool, wherein the extraction tool includes a first member that is configured to grip the first recess on the compression sleeve and a second member that is configured to grip the connector body or the internally-threaded rotatable nut.

10. The coaxial connector in combination with the extraction tool of claim 9, wherein the first member of the extraction tool is received within the first recess.

11. A reusable coaxial connector, comprising:

a connector body that is configured to have a first coaxial cable terminated therein, the connector body further configured so as to be reusable by having a second coaxial cable terminated therein subsequent to use of the connector body on the first coaxial cable;

a contact post that resides at least partly within the connector body;

a compression sleeve that is positioned at least partly within the connector body, wherein the compression sleeve is configured to impart a compressive force that secures one or more elements of a coaxial cable between the connector body and the contact post when the compression sleeve is in a seated position; and an internally threaded rotatable nut that is attached to the connector body, wherein the compression sleeve includes one or more projections that are configured to receive a first member of an extraction tool that is configured to move the compression sleeve from its seated position to an unseated position.

12. The coaxial connector of claim 11, wherein the compression sleeve includes a base portion and a distal portion that extends from the base portion, wherein the base portion of the compression sleeve has an external diameter that is greater than an external diameter of a distal portion of the compression sleeve, and wherein the one or more projections comprises an annular ridge that projects from the base portion of the compression sleeve.

13. The coaxial connector of claim 11, wherein the connector body includes a first recess on an external surface thereof that is configured to receive a second member of the extraction tool, the first recess being accessible from an exterior of the coaxial connector.

14. The coaxial connector of claim 13, wherein the first recess comprises a groove in the connector body.

15. The coaxial connector of claim 13, wherein the first recess comprises at least first and second apertures in the connector body.

16. The coaxial connector of claim 11, wherein the connector body includes one or more projections that are configured to receive a second member of the extraction tool.

17. The coaxial connector of claim 11 in combination with the extraction tool, wherein the extraction tool includes a first member that is configured to grip the one or more projections on the compression sleeve and a second member that is configured to grip the connector body or the internally-threaded rotatable nut.

18. The coaxial connector in combination with the extraction tool of claim 17, wherein the first member of the extraction tool grips the one or more projections.

* * * * *